US010752010B2

(12) United States Patent
Tanaka et al.

(10) Patent No.: US 10,752,010 B2
(45) Date of Patent: Aug. 25, 2020

(54) LIQUID EJECTION APPARATUS

(71) Applicant: BROTHER KOGYO KABUSHIKI KAISHA, Nagoya-shi, Aichi-ken (JP)

(72) Inventors: Nobumasa Tanaka, Nagoya (JP); Tomoyuki Kubo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/212,843

(22) Filed: Dec. 7, 2018

(65) Prior Publication Data

US 2019/0184705 A1 Jun. 20, 2019

(30) Foreign Application Priority Data

Dec. 15, 2017 (JP) ..... 2017-240344

(51) Int. Cl.
*B41J 2/175* (2006.01)

(52) U.S. Cl.
CPC ..... *B41J 2/17566* (2013.01); *B41J 2/175* (2013.01); *B41J 2/17509* (2013.01); *B41J 2/17513* (2013.01); *B41J 2002/17579* (2013.01)

(58) Field of Classification Search
CPC .... B41J 2/17566; B41J 2/17513; B41J 2/175; B41J 2/17509; B41J 2002/17579
See application file for complete search history.

(56) References Cited

U.S. PATENT DOCUMENTS 9,108,423 B2 * 8/2015 Nicholson ..... B41J 2/17566
9,132,656 B2 * 9/2015 Nicholson ..... B41J 2/17566
2009/0040262 A1 2/2009 Watanabe

FOREIGN PATENT DOCUMENTS

JP 2006-327111 A 12/2006
JP 2006-337173 A 12/2006
JP 2008-230227 A 10/2008

* cited by examiner

*Primary Examiner* — Geoffrey S Mruk
(74) *Attorney, Agent, or Firm* — Scully, Scott, Murphy & Presser, PC

(57) ABSTRACT

A liquid ejection apparatus includes a liquid ejector, a resin-made liquid container, a resin-made reference container, a first electrode pair, and a second electrode pair. The liquid ejector is configured to eject liquid. The liquid container defines a space storing liquid to be supplied to the liquid ejector. The liquid container is configured such that a remaining amount of liquid therein changes due to an ejection operation of liquid by the liquid ejector. The reference container defines a space in which no liquid flows to the liquid ejector or from the liquid ejector. The first electrode pair is provided to correspond to the liquid container. The second electrode pair is provided to correspond to the reference container.

20 Claims, 10 Drawing Sheets

FIRST SWITCHING STATE (MEASUREMENT TARGET ELECTRODE PAIR: ELECTRODE PAIR 8K, ELECTRODE PAIR 8C, ELECTRODE PAIR 9)

SECOND SWITCHING STATE (MEASUREMENT TARGET ELECTRODE PAIR: ELECTRODE PAIR 8Y, ELECTRODE PAIR 8M)

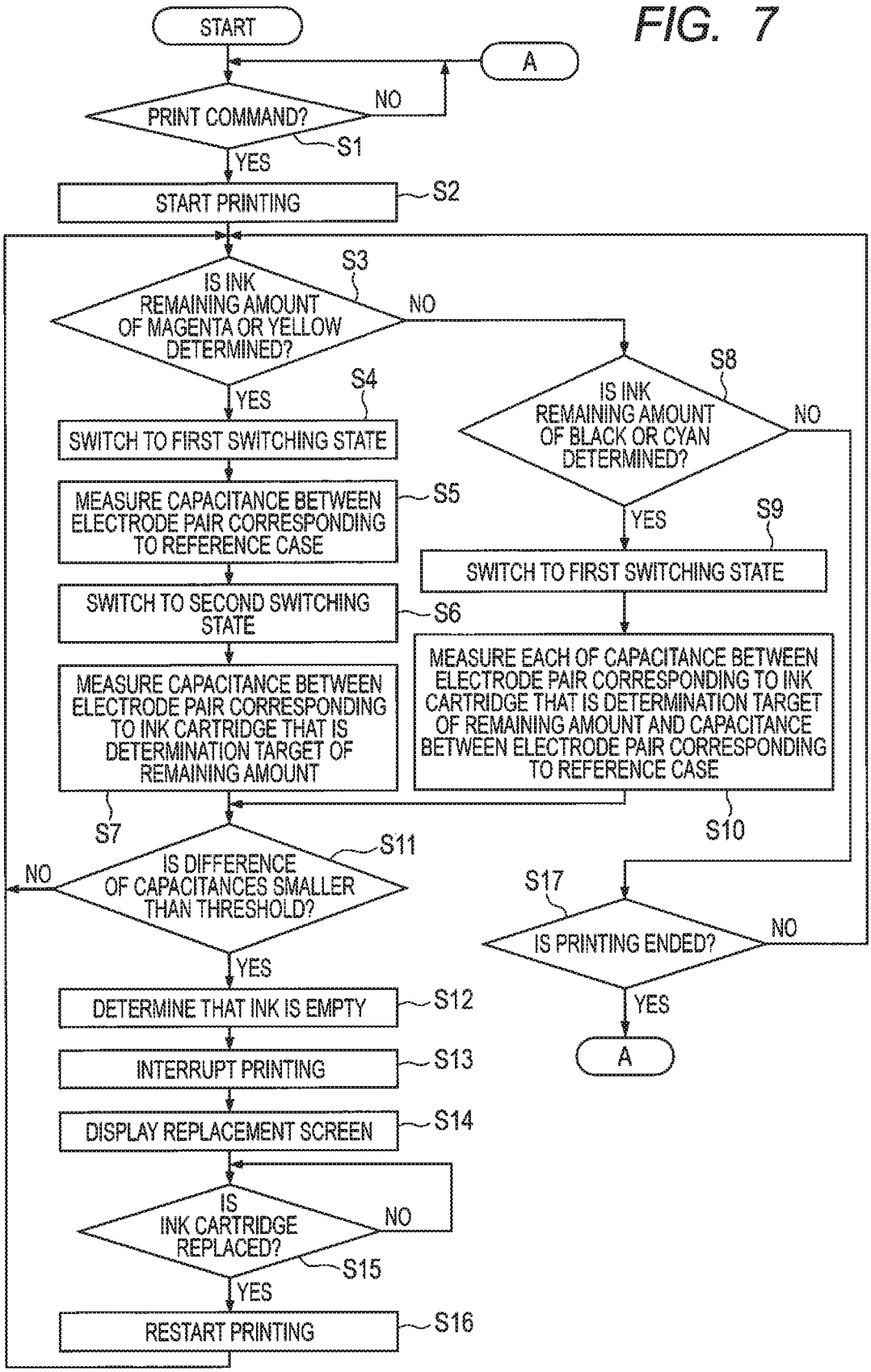
FIG. 7
START
A
PRINT COMMAND?
NO
S1
YES
START PRINTING
S2
IS INK REMAINING AMOUNT OF MAGENTA OR YELLOW DETERMINED?
S3
NO
YES
S4
SWITCH TO FIRST SWITCHING STATE
MEASURE CAPACITANCE BETWEEN ELECTRODE PAIR CORRESPONDING TO REFERENCE CASE
S5
SWITCH TO SECOND SWITCHING STATE
S6
MEASURE CAPACITANCE BETWEEN ELECTRODE PAIR CORRESPONDING TO INK CARTRIDGE THAT IS DETERMINATION TARGET OF REMAINING AMOUNT
S7
IS INK REMAINING AMOUNT OF BLACK OR CYAN DETERMINED?
S8
NO
YES
S9
SWITCH TO FIRST SWITCHING STATE
MEASURE EACH OF CAPACITANCE BETWEEN ELECTRODE PAIR CORRESPONDING TO INK CARTRIDGE THAT IS DETERMINATION TARGET OF REMAINING AMOUNT AND CAPACITANCE BETWEEN ELECTRODE PAIR CORRESPONDING TO REFERENCE CASE
S10
IS DIFFERENCE OF CAPACITANCES SMALLER THAN THRESHOLD?
S11
NO
YES
DETERMINE THAT INK IS EMPTY
S12
INTERRUPT PRINTING
S13
DISPLAY REPLACEMENT SCREEN
S14
IS INK CARTRIDGE REPLACED?
NO
S15
YES
RESTART PRINTING
S16
IS PRINTING ENDED?
S17
NO
YES
A

LIQUID EJECTION APPARATUS

CROSS REFERENCE TO RELATED APPLICATIONS

This application claims priority from Japanese Patent Application No. 2017-240344 filed Dec. 15, 2017. The entire content of the priority application is incorporated herein by reference.

TECHNICAL FIELD

This disclosure relates to a liquid ejection apparatus.

BACKGROUND

A technique is disclosed according to which an ink container for storing ink to be supplied to an inkjet head includes an electrode pair and this electrode pair is used to determine the ink remaining amount in the ink container. Specifically, according to this technique, attention is given to a point that a change in the ink remaining amount causes a change in the capacitance between the electrode pair and ink remaining amount is determined by acquiring the capacitance between the electrode pair.

SUMMARY

According to one aspect, this specification discloses a liquid ejection apparatus. The liquid ejection apparatus includes a liquid ejector, a resin-made liquid container, a resin-made reference container, a first electrode pair, and a second electrode pair. The liquid ejector is configured to eject liquid. The liquid container defines a space storing liquid to be supplied to the liquid ejector. The liquid container is configured such that a remaining amount of liquid therein changes due to an ejection operation of liquid by the liquid ejector. The reference container defines a space in which no liquid flows to the liquid ejector or from the liquid ejector. The first electrode pair is provided to correspond to the liquid container. The second electrode pair is provided to correspond to the reference container.

According to another aspect, this specification also discloses a liquid ejection apparatus. The liquid ejection apparatus includes a liquid ejector, a resin-made liquid container, a resin-made reference container, a first electrode pair, and a second electrode pair. The liquid ejector is configured to eject liquid. The liquid container defines a space storing liquid to be supplied to the liquid ejector. The liquid container is configured such that a remaining amount of liquid therein changes due to an ejection operation of liquid by the liquid ejector. The reference container is configured such that an amount of liquid therein is unchanged regardless of the ejection operation of liquid by the liquid ejector. The first electrode pair is provided to correspond to the liquid container. The second electrode pair is provided to correspond to the reference container.

BRIEF DESCRIPTION OF THE DRAWINGS

Embodiments in accordance with this disclosure will be described in detail with reference to the following figures wherein:

FIG. 7 illustrates a processing operation of the inkjet printer;

DETAILED DESCRIPTION

With a method of determining a remaining liquid amount stored in the ink container that uses the electrode pair, a risk is present where a change in the environment causes lower determination accuracy. For example, a change in the environment temperature causes a change in the dielectric constant of an ink container storing liquid and the liquid stored in the ink container. Thus, even when there is no change in the remaining liquid amount, the capacitance changes between an electrode pair. Accordingly, with a method of determining the remaining liquid amount stored in the ink container based on the capacitance between the electrode pair, a change in the environment temperature causes lower determination accuracy.

Thus, it is an example of an objective of this disclosure to provide a liquid ejection apparatus that improves the accuracy of determining the remaining amount of liquid.

First Embodiment

Figure 1:
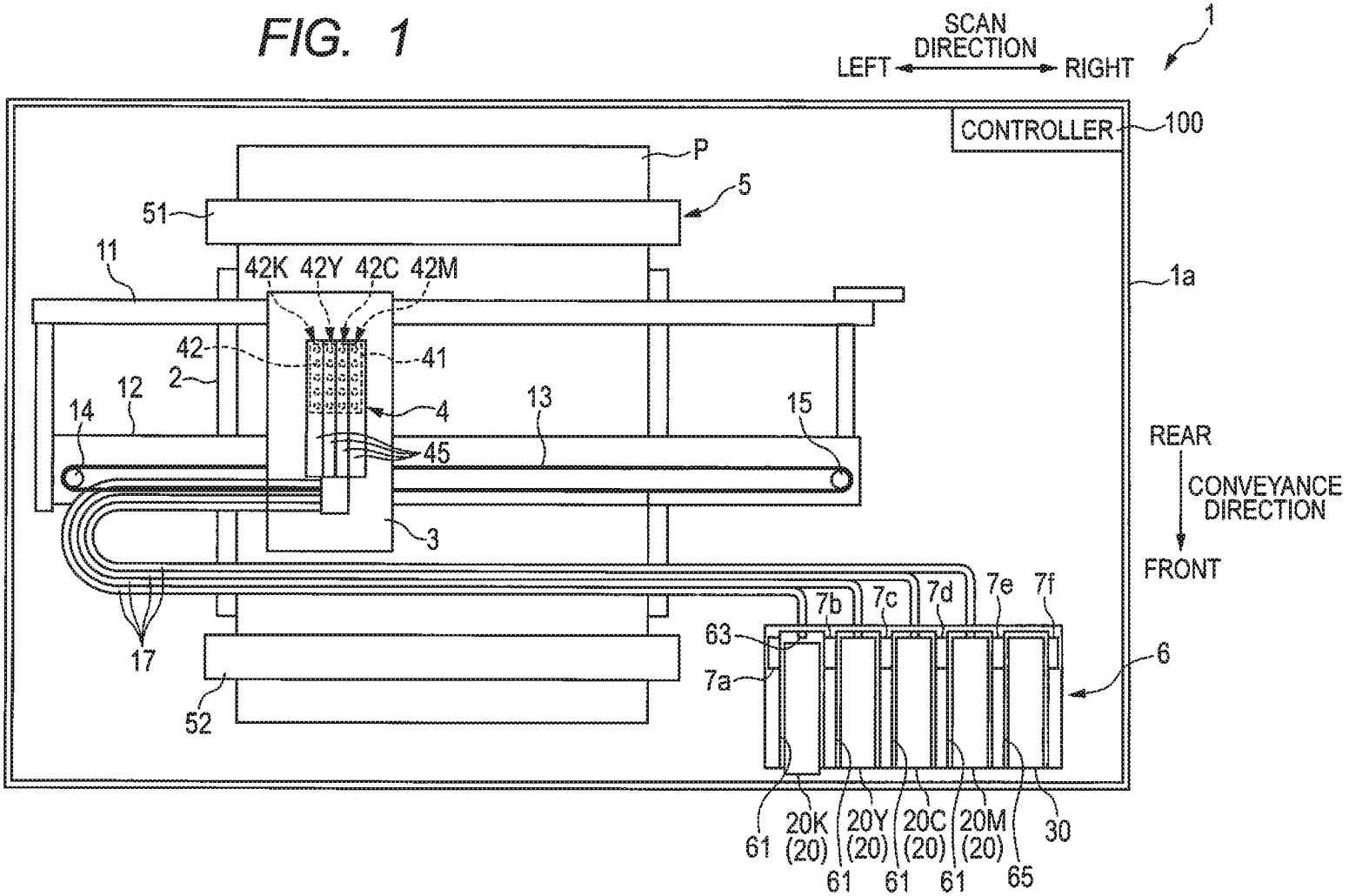
FIG. 1 is a schematic plan view illustrating an inkjet printer according to a first embodiment.

The following section will describe a first embodiment of this disclosure. The following description will be made based on an assumption that an inkjet printer 1 (hereinafter, printer 1) is a liquid ejection apparatus as an example. As shown in FIG. 1, the printer 1 has a substantially rectangular parallelepiped-like housing 1*a*. The housing 1*a* accommodates therein a platen 2, a carriage 3, an inkjet head 4 (hereinafter, head 4), a conveyance mechanism 5, a holder 6, a controller 100, a power supply circuit 110 (see FIG. 6), a switching circuit 120 (see FIG. 6), and a capacitance measurement circuit 130 (see FIG. 6), for example. In the following section, the term "upper-lower direction" is defined in a state where the printer 1 is placed on a horizontal plane in a usable manner (the orientation of FIG. 1 which may be hereinafter referred to as "use orientation"). The front-rear direction and the left-right direction shown in FIG. 1 are defined as the "front-rear direction" and "left-right direction" of the printer 1. The front-rear direction and the left-right direction are directions parallel to the horizontal plane, and the upper-lower direction is a direction vertical to the horizontal plane. The following description will be made while using the front-rear direction, the left-right direction and the front-rear direction as required, respectively.

Paper P as a recording medium is placed on the upper surface of the platen 2. Two guide rails 11 and 12 extending in parallel in the left-right direction (scan direction) are provided at the upper side of the platen 2.

The carriage 3 is attached to two guide rails 11 and 12 and is moved in the left-right direction along the two guide rails 11 and 12 in a region facing the platen 2. The carriage 3 is attached with a driving belt 13. The driving belt 13 is an endless belt wound around two pulleys 14 and 15. One pulley 14 is connected to a carriage driving motor 16 (see FIG. 6). The carriage driving motor 16 drives the pulley 14 to rotate to thereby run the driving belt 13, which causes a reciprocating movement of the carriage 3 in the left-right direction, during which the head 4 mounted on the carriage 3 reciprocates together with the carriage 3 in the left-right direction.

The holder 6 includes therein four first receivers (receiving portions) 61 arranged in the left-right direction. Each of the first receivers 61 receives an ink cartridge 20 in a detachable manner The four ink cartridges 20 received in the four first receivers 61 store black, yellow, cyan, and magenta ink, respectively. The four ink cartridges 20 have the same configuration. Thus, the following section will describe the configuration of one ink cartridge 20.

Figure 2A:
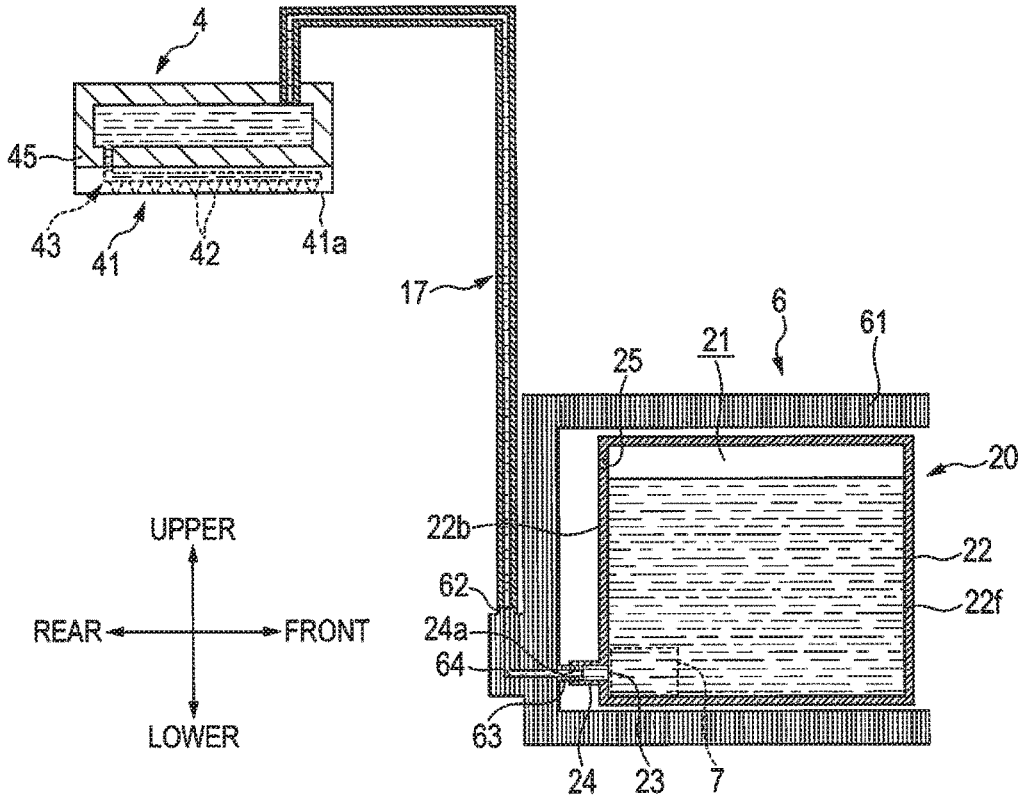
FIG. 2A is a vertical cross-sectional view schematically illustrating an inkjet head, a first receiver, and an ink cartridge.
Figure 3A:
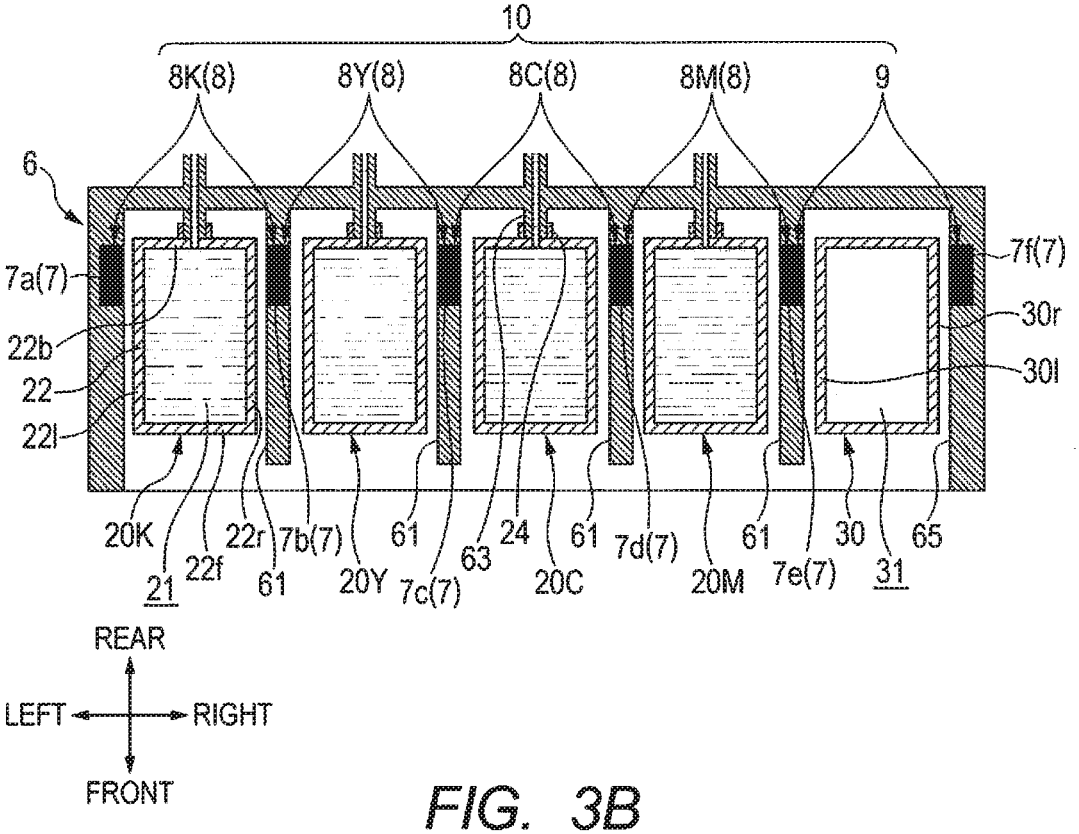
FIG. 3A is a schematic plan view illustrating a holder, the ink cartridges, and the reference case.

As shown in FIG. 2A, the ink cartridge 20 is mainly configured by a substantially rectangular parallelepiped-like case 22 defining an internal space 21 in which ink is stored. The case 22 is made of resin. As shown in FIG. 3A, the case 22 has a left side wall 22*l* and a right side wall 22*r* extending along a vertical plane parallel to the front-rear direction. The case 22 has a front wall 22*f* and a rear wall 22*b* extending along a vertical plane parallel to the left-right direction. The left side wall 22*l* has the same thickness as that of the right side wall 22*r*.

As shown in FIG. 2A, the case 22 has, at a lower part of the rear wall 22*b*, a discharge port 23 penetrating through the rear wall 22*b* in the front-rear direction. This discharge port 23 is an opening that supplies the ink stored in the internal space 21 to the outside. A part of the rear wall 22*b* at which the discharge port 23 is formed has a cylindrical ink supply portion 24 protruding to the rear side. The ink supply portion 24 has an internal space communicating with the internal space 21 through the discharge port 23.

The internal space of the ink supply portion 24 has, at a tip end thereof, an insertion hole 24*a* to which a needle 63 (described later) is inserted. When the ink cartridge 20 is not received by the first receiver 61, the insertion hole 24*a* is closed by a valve (not shown). When the ink cartridge 20 is received by the first receiver 61, then the valve is pushed by the needle 63 of the first receiver 61, thereby opening the insertion hole 24*a*.

The case 22 has, at an upper part of the rear wall 22*b*, an air communication port 25 penetrating through the rear wall 22*b*. The air communication port 25 communicates with a gas layer at the upper side of the liquid surface of the ink in the internal space 21 and the outside (air).

The first receiver 61 has a tube joint 62, the needle 63 formed by a tube-like resin needle, and an internal flow channel 64 that provides communication between the tube joint 62 and the needle 63. The tube joint 62 is connected to a flexible tube 17. The tube 17 has one end connected to the tube joint 62 and the other end connected to the head 4.

When the first receiver 61 receives the ink cartridge 20, the needle 63 is inserted to the insertion hole 24*a* of the ink cartridge 20 to thereby provide communication between the internal space 21 of the ink cartridge 20 and the head 4, through the internal flow channel 64 and the tube 17. This consequently allows the ink stored in the internal space 21 of the ink cartridge 20 to be supplied to the head 4. That is, an ink flow is generated between the internal space 21 of the ink cartridge 20 and the head 4.

Each first receiver 61 has a reception detection sensor 69 (see FIG. 6) that detects whether the ink cartridge 20 is received by the first receiver 61.

In the following description, elements of the inkjet printer that correspond to black (K), yellow (Y), cyan (C), and magenta (M) inks are denoted such that the reference numeral that indicates the element is followed by any one of "K" indicating black, "Y" indicating yellow, "C" indicating cyan, and "M" indicating magenta in order to indicate which ink corresponds to the element. For example, the ink cartridge 20K indicates the ink cartridge 20 storing black ink.

Figure 2B:
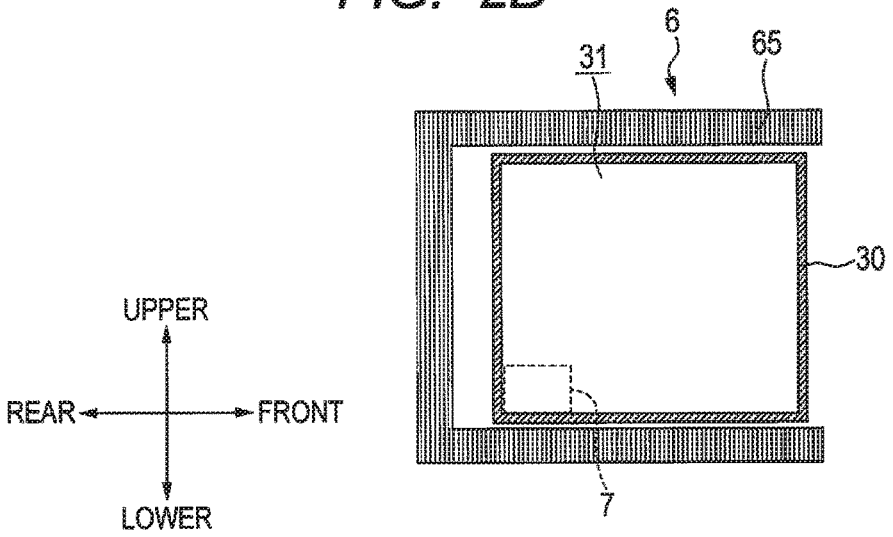
FIG. 2B is a vertical cross-sectional view schematically illustrating a second receiver and a reference case.

As shown in FIG. 1, the holder 6 has one second receiver (receiving portion) 65 provided at the right side of four first receivers 61. The second receiver 65 receives a reference case 30. The reference case 30 is a substantially rectangular parallelepiped-like case. The reference case 30 is formed from the same resin material as the case 22 of the ink cartridge 20. As shown in FIG. 2B, the reference case 30 defines an internal space 31 therein. The internal space 31 stores no liquid such as ink and contains only air. The ink cartridges 20 and the reference case 30 are arranged in juxtaposition. More specifically, the ink cartridges 20 and the reference case 30 are arranged in the left-right direction. Further, the electrode 7*e* (common electrode) is arranged between the ink cartridge 20M and the reference case 30 in the left-right direction.

As shown in FIG. 3A, the reference case 30 has a left side wall 30*l* and a right side wall 30*r* extending along the vertical plane parallel to the front-rear direction. The left side wall 30*l* has the same thickness as that of the left side wall 22*l* of the case 22. The right side wall 30*r* of the reference case 30 has the same thickness as that of the right side wall 22*r* of the case 22. The interval between the left side wall 30*l* and the right side wall 30*r* of the reference case 30 in the left-right direction is the same as the interval between the left side wall 22*l* and the right side wall 22*r* of the case 22 in the left-right direction.

In contrast with the case 22 of the ink cartridge 20, the reference case 30 does not have a communication opening such as a discharge port or an air communication port that provides communication between the internal space 31 and the outside. Specifically, the internal space 31 is sealed. In contrast with the first receiver 61, the second receiver 65 has no needle and so on. Thus, the internal space 31 of the reference case 30 is not connected to (no fluid communication with) the head 4, thus preventing ink from flowing between the internal space 31 and the head 4. The internal space 31 of the reference case 30 is not connected to (no fluid communication with) the internal space 21 of each ink cartridge 20, thus preventing ink from flowing between the internal space 31 and the ink cartridges. Accordingly, ink is prevented from being supplied to the internal space 31 of the reference case 30 from the head 4 or the ink cartridges 20. The lower end position of the internal space 31 of the reference case 30 is set to have the same height as that of the lower end position of the internal space 21 of the ink cartridge 20.

As shown in FIG. 1, the holder 6 has six electrodes 7*a*, 7*b*, 7*c*, 7*d*, 7*e*, and 7*f* arranged in this order in the left-right direction from the left side. These six electrodes 7*a*, 7*b*, 7*c*, 7*d*, 7*e*, and 7*f* have the same configuration and are used to determine the ink remaining amount in the ink cartridge 20 as described later. In the following description, the electrodes 7*a*, 7*b*, 7*c*, 7*d*, 7*e*, and 7*f* will be collectively referred to as "electrode 7" when no differentiation is made thereamong or when collective reference is made to the electrodes. The details of the configuration of the electrode 7 will be described later.

The head 4 is mounted on the carriage 3 while forming a gap between the head 4 and the platen 2. The head 4 has a head body 41 and four buffer tanks 45 that are provided at the upper surface of the head body 41 and that are used to temporarily store ink supplied to the head body 41. Each buffer tank 45 is connected to a tube 17. Each buffer tank 45 receives ink supplied from the corresponding ink cartridge 20 through the tube 17.

The lower surface of the head body 41 is an ejection surface 41*a* (see FIG. 2A) in which a plurality of nozzles 42 opens. The nozzles 42 are arranged in the front-rear direction to form four nozzle arrays 42K, 42Y, 42C, and 42M. The four nozzle arrays 42K, 42Y, 42C, and 42M are arranged in the left-right direction and are configured by a plurality of nozzles 42 that ejects black, yellow, cyan, and magenta ink, respectively.

The head body 41 includes therein a common ink flow channel 43 for each color (for each nozzle array 42K, 42Y, 42C, and 42M). The ink flow channel 43 (see FIG. 2A) is a flow channel that provides communication between a buffer tank 45 and the nozzles 42. The head body 41 has an actuator 44 (see FIG. 6) that applies a pressure to the ink in the ink flow channel 43 to cause ink to be ejected through the nozzle 42. The actuator is not limited to the one having a specific configuration and one example is a piezoelectric actuator in which ink is pressurized by the inverse piezoelectric effect of a piezoelectric layer serving as a drive element. An actuator having another configuration may be used in which a heating element that heats ink to cause film boiling is provided as a drive element.

Under control by the controller 100, the head 4 performs an ejection operation that drives the actuator 44 to thereby eject ink through the nozzles 42. The eject operation performed by the head 4 causes the ink in the ink cartridge 20 to be supplied to the head 4 in an amount corresponding to the ink ejected through the nozzles 42. Accordingly, the eject operation of the head 4 causes a reduction of the ink remaining amount in the ink cartridge 20.

The conveyance mechanism 5 has two conveyance rollers 51 and 52 arranged at front and rear sides of the platen 2 and the carriage 3 so as to sandwich the same. The two conveyance rollers 51 and 52 are driven by a conveyance motor 53 (see FIG. 6) in a synchronized manner to rotate to thereby convey the paper P between the head 4 and the platen 2 in the forward direction (conveyance direction).

In the above configuration, the printer 1 prints a desired image for example on the paper P by moving the head 4 together with the carriage 3 in the scan direction to eject ink while conveying the paper P in the conveyance direction by the conveyance mechanism 5. Specifically, the printer 1 of this embodiment is a serial-type inkjet printer.

The printer 1 has a touch panel 90 (see FIG. 6) at the front wall of the housing 1*a*. The touch panel 90 is a user interface through which various operation inputs from a user are received or various setting screens or operation states for example are displayed to the user.

Figure 6:
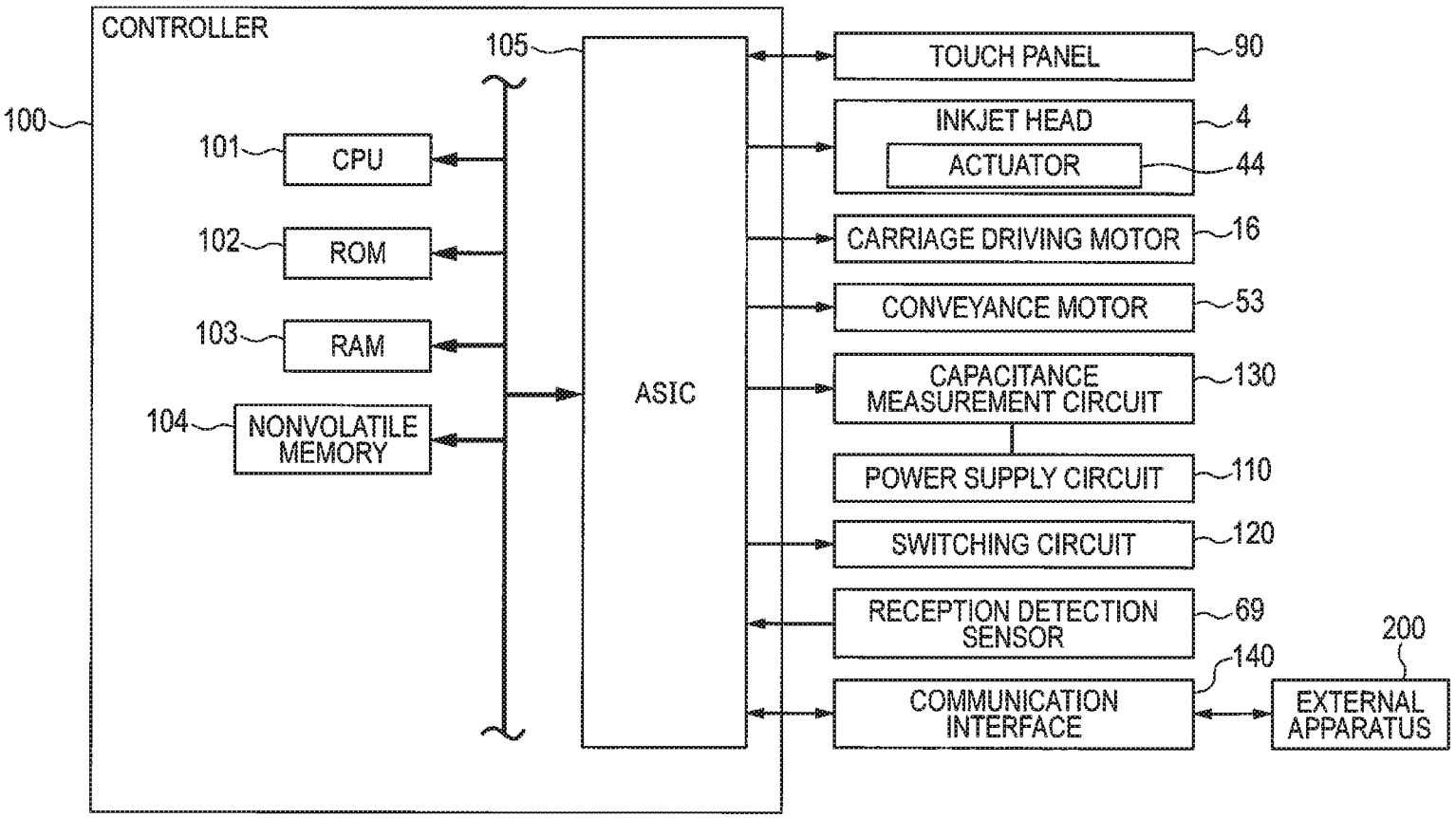
FIG. 6 is a block diagram schematically illustrating the electrical configuration of the inkjet printer.

As shown in FIG. 6, the controller 100 includes a CPU (Central Processing Unit) 101, a ROM (Read Only Memory) 102, a RAM (Random Access Memory) 103, a nonvolatile memory 104, an ASIC (Application Specific Integrated Circuit) 105 including various control circuits, and so on. The head 4, the carriage driving motor 16, the conveyance motor 53, the touch panel 90, and so on are electrically connected to the ASIC 105.

The ROM 102 stores programs executed by the CPU 101, various fixed data, and so on. The RAM 103 temporarily stores data needed when executing the programs (image data and so on).

The ASIC 105 is electrically connected to a communication interface 140. The CPU 101 executes printing processing that prints the image on the paper P by controlling, through the communication interface 140, the head 4 and the carriage driving motor 16 for example based on a print command sent from an external apparatus 200 such as a PC. The CPU 101 controls the capacitance measurement circuit 130 to execute remaining amount determination processing that determines the ink remaining amount in each ink cartridge 20. In this embodiment, the CPU 101 determines, in the remaining amount determination processing, whether the ink cartridge 20 has an ink remaining amount of zero (an empty state in which the ink cartridge 20 requires replacement).

In the embodiment, the controller 100 is configured to execute each processing by a single CPU. However, the controller 100 may be configured to execute each processing by a plurality of CPUs, a single ASIC (application specific integrated circuit), a plurality of ASICs, or a combination of a CPU and a particular ASIC.

The following section will describe the six electrodes 7, the switching circuit 120, and the capacitance measurement circuit 130.

Figure 3B:
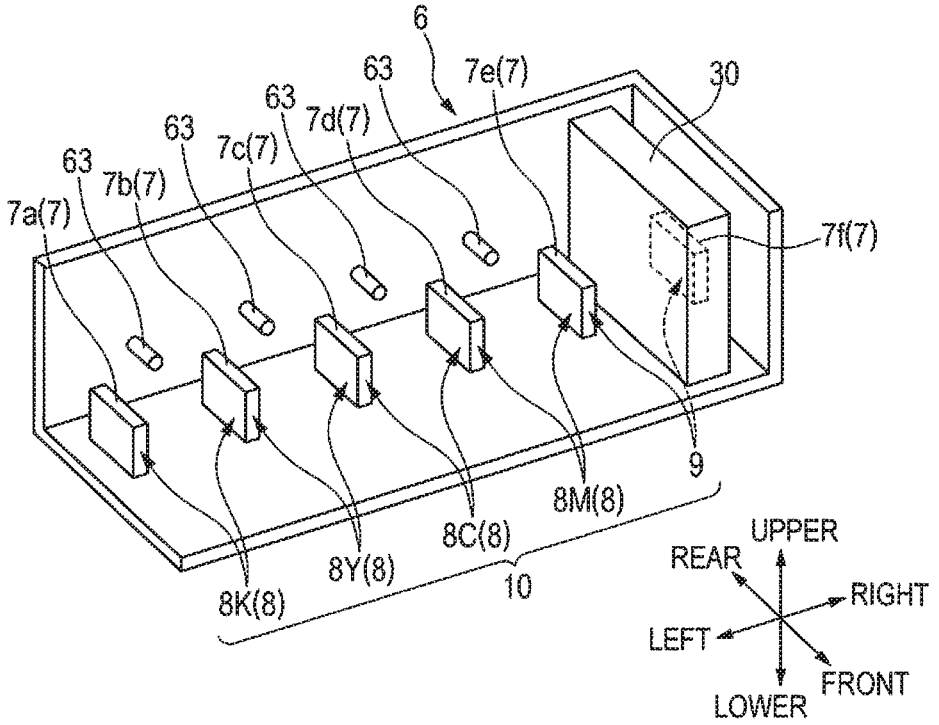
FIG. 3B is a perspective view illustrating the holder and the reference case.

As shown in FIGS. 3A and 3B, the six electrodes 7 are plate electrodes extending along a vertical plane parallel to the front-rear direction. The six electrodes 7 have the same size, respectively. That is, the six electrodes 7 have the same thickness in the thickness direction (the left-right direction in FIGS. 3A and 3B), and surfaces of the six electrodes 7 perpendicular to the thickness direction have the same area. The six electrodes 7 have lengths in the upper-lower direction shorter than the lengths of the left side wall 22*l* and the right side wall 22*r* of the case 22 and the lengths in the upper-lower direction of the left side wall 30*l* and the right side wall 30*r* of the reference case 30. Similarly, the six electrodes 7 have lengths in the front-rear direction shorter than those of the left side wall 22*l*, the right side wall 22*r*, the left side wall 30*l*, and the right side wall 30*r* in the front-rear direction. The six electrodes 7 are arranged at the same position with respect to the front-rear direction and are arranged at the same position with respect to the upper-lower direction. Thus, the six electrodes 7 overlap one another when being looked at in the left-right direction. In FIG. 3B, a part of the walls of the holder 6 is omitted for convenience.

Two electrodes 7 adjacent to each other in the left-right direction constitute an electrode pair 10 serving as a parallel plate capacitor. Specifically, in this embodiment, the six electrodes 7 constitute five electrode pairs 10 arranged in the left-right direction. Among the six electrodes 7, four electrodes 7*b*, 7*c*, 7*d*, and 7*e*, excluding the electrode 7*a* at the left end and the electrode 7*f* at the right end, are common electrodes of two electrode pairs 10 adjacent to each other in the left-right direction. The six electrodes 7 are arranged to have an equal interval in the left-right direction. Thus, the five electrode pairs 10 are arranged to have an equal interval.

The five electrode pairs 10 include four electrode pairs 8 (8K, 8Y, 8C, and 8M) corresponding to four ink cartridges 20 and one electrode pair 9 corresponding to the reference case 30.

More specifically, each of the four electrode pairs 8 has therebetween one of the four ink cartridges 20. Namely, the ink cartridge 20K is provided between an electrode 7*a* and an electrode 7*b* constituting the electrode pair 8K. The electrode 7*a* faces the left side wall 22*l* of the case 22 of the ink cartridge 20K. The electrode 7*b* faces the right side wall 22*r* of the case 22 of the ink cartridge 20K. Similarly, the ink cartridge 20Y is provided between the electrode 7*b* and the electrode 7*c* that constitute the electrode pair 8Y. The ink cartridge 20C is provided between the electrode 7*c* and the electrode 7*d* that constitute the electrode pair 8C. An ink cartridge 20M is provided between the electrode 7*d* and the electrode 7*e* that constitute the electrode pair 8M.

As described above, each of the four electrode pairs 8K, 8Y, 8C, and 8M is provided to have the corresponding ink cartridge 20 therebetween. In other words, the two ink cartridges 20 adjacent to each other in the left-right direction have therebetween the electrodes 7*b*, 7*c*, and 7*d* serving as a common electrode to two electrode pairs 8K, 8Y, 8C, and 8M adjacent to each other in the left-right direction. No wall of the first receiver 61 and so on is arranged between the four electrode pairs 8K, 8Y, 8C, and 8M. That is, only the corresponding ink cartridge 20 is arranged between the four electrode pairs 8K, 8Y, 8C, and 8M, except the gap between the electrodes and the corresponding ink cartridge 20.

The reference case 30 is provided between the electrode 7*e* and the electrode 7*f* that constitute an electrode pair 9. In other words, the electrode 7*e* serving as a common electrode to the electrode pair 8M and the electrode pair 9 is arranged between the ink cartridge 20M and the reference case 30. No wall of the second receiver 65 and so on is arranged between the electrode pair 9. That is, only the reference case 30 is arranged between the electrode pair 9, except the gaps between the electrodes and the reference case 30.

As shown in FIG. 2A, the lower end position of the six electrodes 7 is set to have the same height as the lower end position of the internal space 21 of the ink cartridge 20 and the lower end position of the internal space 31 of the reference case 30. The rear end position of the six electrodes 7 is set to have the same position in the front-rear direction as the rear wall 22*b* of the ink cartridge 20. The six electrodes 7 are arranged closer to the rear wall 22*b* in the front-rear direction than to the front wall 22*f* of the case 22 of the ink cartridge. In the above configuration, the six electrodes 7 are arranged in the vicinity of the discharge port 23 that discharges ink in the ink cartridge 20.

Figure 4A:
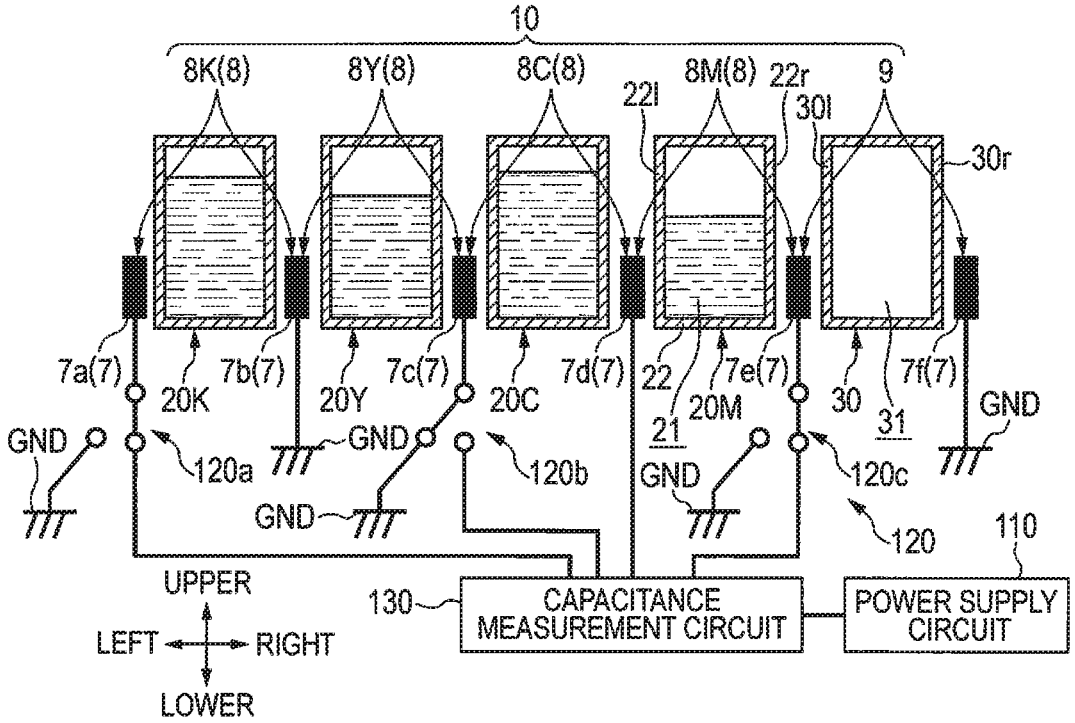
FIGS. 4A and 4B schematically illustrate the connection between electrodes and a capacitance measurement circuit.
Figure 4B:
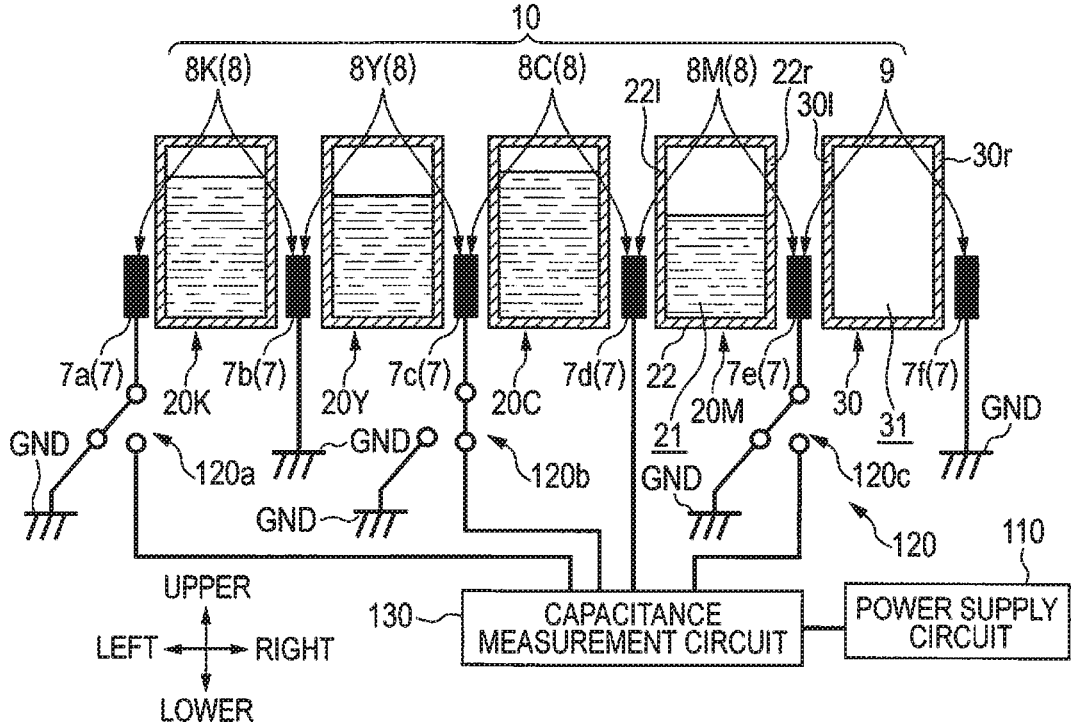

As shown in FIGS. 4A and 4B, the two electrodes 7*b* and 7*f* of the six electrodes 7 are connected to a ground GND. Thus, the two electrodes 7*b* and 7*f* are maintained to have a ground potential. The electrode 7*d* is connected to the capacitance measurement circuit 130. The three electrodes 7*a*, 7*c*, and 7*e* are connected to the switching circuit 120.

The capacitance measurement circuit 130 measures the capacitance between each electrode pair 10. The capacitance between each electrode pair 10 has a magnitude that changes depending on the dielectric body between the electrode pair 10. The ink in each ink cartridge 20 functions as a dielectric body. Thus, the capacitance between each electrode pair 8 changes depending on the ink remaining amount in the corresponding ink cartridge 20. Accordingly, it may be considered that, by storing, in the nonvolatile memory 104 and so on, the correspondence between the capacitance between each electrode pair 8 and the ink remaining amount in the corresponding ink cartridge 20, the ink remaining amount can be determined with good accuracy.

However, the ink dielectric constant changes in accordance with a change in the environment temperature. In addition, the case 22 of the ink cartridge 20 between the electrode pair 8 is also a dielectric body formed from resin. Thus, the dielectric constant of the case 22 also changes in accordance with a change in the environment temperature. Accordingly, the capacitance between each electrode pair 8 changes in accordance with a change in the environment temperature, even when there is no change in the ink remaining amount in the corresponding ink cartridge 20. As a result, the ink remaining amount in the ink cartridge 20 is not always accurately determined even if the capacitance between each electrode pair 8 has been measured.

To solve this, this embodiment measures the capacitance between the electrode pair 9 provided to correspond to the reference case 30 and determines the ink remaining amount in each ink cartridge 20, based on this measurement result and the measurement result of the capacitance between the electrode pair 8.

As described above, the five electrode pairs 10 are arranged to have an equal interval therebetween and have the same size. Thus, the magnitude of the capacitance between each electrode pair 10 differs due to the dielectric constant of the dielectric body between the electrodes that constitute the electrode pair 10.

The case 22 of the ink cartridge 20 and the reference case 30 are accommodated in the same housing 1*a* and are received by the same holder 6. Thus, the case 22 has an environment that is substantially the same as the environment of the reference case 30. Since the case 22 and the reference case 30 are formed from the same material, even when the environment temperature changes, the dielectric constants thereof are substantially the same. The left side wall 22*l* of the case 22 has a thickness equal to that of the left side wall 30*l* of the reference case 30. The right side wall 22*r* of the case 22 has a thickness equal to that of the right side wall 30*r* of the reference case 30. Accordingly, an influence caused by the case 22 as a dielectric body on the capacitance between each electrode pair 8 is substantially the same as an influence caused by the reference case 30 as a dielectric body on the capacitance between the electrode pair 9.

Furthermore, no ink is stored in the reference case 30. In addition, the interval between the left side wall 22*l* and the right side wall 22*r* of the case 22 is equal to the interval between the left side wall 30*l* and the right side wall 30*r* of the reference case 30. Thus, when the ink remaining amount in the ink cartridge 20 is zero, substantially no difference is present between the capacitance between the electrode pair 8 corresponding to the ink cartridge 20 and the capacitance between the electrode pair 9 corresponding to the reference case 30.

More specifically, when the liquid surface of the ink in the ink cartridge 20 exists above the upper end position of the electrode 7, ink is present between the electrode pair 8. Thus, a significant difference is present among the capacitance between the electrode pair 8 and the capacitance between the electrode pair 9. However, as the liquid surface of the ink in the ink cartridge 20 descends from the upper end position of the electrode 7, the amount of ink present between the electrode pair 8 becomes smaller. Thus, the difference between the capacitance between the electrode pair 8 and the capacitance between the electrode pair 9 becomes smaller. When the ink remaining amount in the ink cartridge 20 is zero, substantially no difference is present between the capacitance between the electrode pair 8 and the capacitance between the electrode pair 9. Thus, according to this embodiment, when the difference between the capacitance between the electrode pair 8 and the capacitance between the electrode pair 9 becomes smaller than a particular threshold, the ink cartridge 20 corresponding to the electrode pair 8 is determined to be an empty state.

Figure 5A:
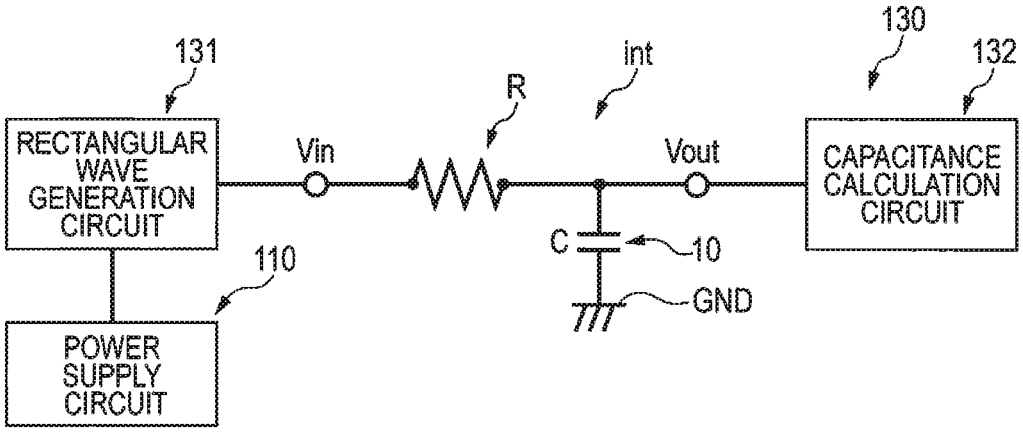
FIG. 5A is a circuit diagram illustrating the capacitance measurement circuit.
Figure 5B:
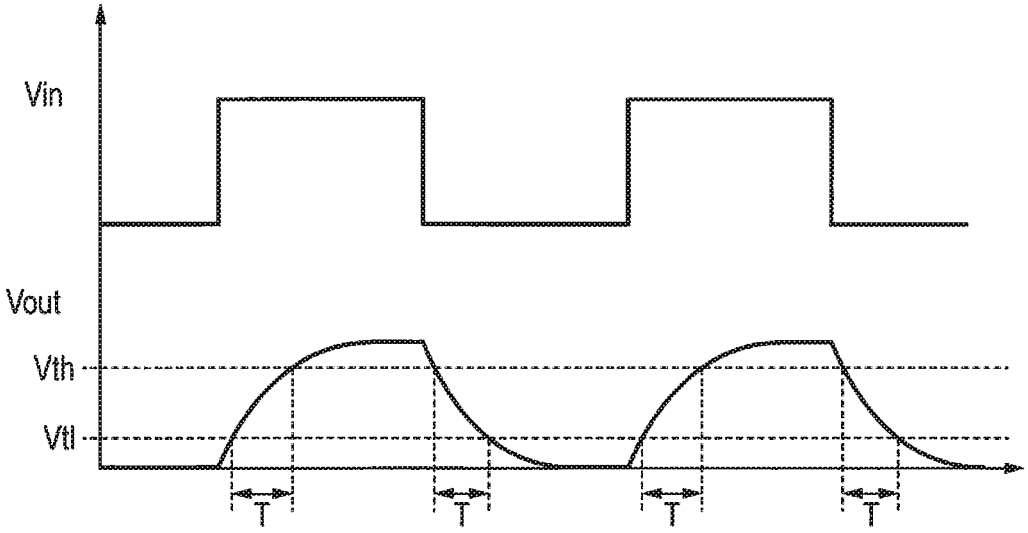
FIG. 5B illustrates the operation of the capacitance measurement circuit.

The capacitance measurement circuit 130 measures the capacitance between the electrode pair 10 (hereinafter also may be referred to as the electrode pair 10 as a measurement target) connected to the capacitance measurement circuit 130. With reference to FIGS. 5A and 5B, the following section will describe the capacitance measurement circuit 130 in detail. FIG. 5A illustrates the connection relation between one electrode pair 10 and the capacitance measurement circuit 130 for the convenience of description.

As shown in FIG. 5A, the capacitance measurement circuit 130 has a resistor R, a rectangular wave generation circuit 131, and a capacitance calculation circuit 132. The resistor R and the capacitor formed by the electrode pair 10 as the measurement target constitute an integration circuit (a serial RC circuit) int. This integration circuit int has a time constant obtained by multiplying the resistance value of the resistor R by the capacitance of the capacitor formed the electrode pair 10 of the measurement target. In this embodiment, the resistor R has a fixed resistance value. Thus, the time constant of the integration circuit int changes depending on the capacitance between the electrode pair 10 of the measurement target.

The rectangular wave generation circuit 131 is connected to the power supply circuit 110 that generates a voltage. As shown in FIG. 5B, the rectangular wave generation circuit 131 is configured to generate a rectangular wave-like pulse voltage signal Vin in which a voltage value is switched between a voltage outputted from the power supply circuit 110 and the ground voltage. The rectangular wave generation circuit 131 inputs the generated pulse voltage signal Vin to the integration circuit int. Accordingly, the pulse voltage signal Vin inputted from the rectangular wave generation circuit 131 to the integration circuit int responds at the speed depending on the time constant of the integration circuit int. That is, a voltage signal Vout outputted from the integration circuit int has a waveform obtained by dulling the waveform of the pulse voltage signal Vin depending on the time constant of the integration circuit int.

The capacitance calculation circuit 132 calculates, based on the voltage signal Vout outputted from the integration circuit int, the capacitance between the electrode pair 10 of the measurement target. When the voltage signal Vout rises or falls, the voltage signal Vout changes between a threshold voltage Vt1 and a threshold voltage Vth during the transition time T. The transition time T has a correlation with the time constant of the integration circuit int. For example, the transition time T increases in accordance with the increase of the time constant of the integration circuit int. Accordingly, the time constant of the integration circuit int can be calculated from the transition time T. As described above, the resistor R of the integration circuit int has a fixed resistance value. Thus, by calculating the time constant of the integration circuit int, the capacitance between the electrode pair 10 of the measurement target is also calculated. Accordingly, the capacitance calculation circuit 132 calculates the transition time T of the voltage signal Vout and, based on the transition time T, calculates the capacitance between the electrode pair 10 of the measurement target.

As described above, the four electrodes 7*b*, 7*c*, 7*d*, and 7*e* are electrodes common to the two electrode pairs 10 adjacent to each other in the left-right direction. By using one electrode of each of the two electrode pairs 10 adjacent to each other as a common electrode, the number of the electrodes 7 is reduced. This consequently provides an advantage such that the holder 6 has a smaller size for example. This also consequently causes a disadvantage that the capacitance measurement circuit 130 cannot simultaneously measure the capacitance of all electrode pairs 10. For example, a case will be considered in which, when the capacitance of the two electrode pairs 8K and 8Y adjacent to each other is measured, the pulse voltage signal Vin is applied to the electrode 7*b* from the capacitance calculation circuit 132 while the electrode 7*a* and the electrode 7*c* are connected to the ground GND. In this case, the capacitance that is calculated is a combined capacitance composed of the capacitance between the electrode pair 8K and the capacitance between the electrode pair 8Y. That is, the capacitance between the electrode pair 8K and the capacitance between the electrode pair 8Y cannot be calculated separately.

To solve this, according to this embodiment, instead of measuring the capacitances between the five electrode pairs 10 at the same time, these capacitances are measured in two steps. The switching circuit 120 selectively switches the electrode pair 10 of the measurement target of the capacitance measurement circuit 130.

As shown in FIGS. 4A and 4B, the switching circuit 120 has three switches 120*a*, 120*b*, and 120*c*. The switch 120*a* switches the connection destination of the electrode 7*a* between the ground GND and the capacitance measurement circuit 130. Similarly, the switch 120*b* switches the connection destination of the electrode 7*c* between the ground GND and the capacitance measurement circuit 130. The switch 120*c* switches the connection destination of the electrode 7*e* between the ground GND and the capacitance measurement circuit 130.

The switching circuit 120 is configured to switch, under control by the controller 100, between two switching states of the first switching state and the second switching state. As shown in FIG. 4A, the first switching state is a state in which the connection destination of the electrode 7*a* and the electrode 7*e* is the capacitance measurement circuit 130 and the connection destination of the electrode 7*c* is the ground GND. In the first switching state, three electrode pairs 8K, 8C, and 9 are the electrode pairs 10 of the measurement target and the capacitance is measured by the capacitance measurement circuit 130.

As shown in FIG. 4B, the second switching state is a state in which the connection destination of the electrode 7*a* and the electrode 7*e* is the ground GND and the connection destination of the electrode 7*c* is the capacitance measurement circuit 130. In the second switching state, two electrode pairs 8Y and 8M are the electrode pairs 10 of the measurement target and the capacitance is measured by the capacitance measurement circuit 130.

The printer 1 generally consumes black ink in an amount larger than those of the other three color inks. Accordingly, the ink remaining amount in the ink cartridge 20K that stores black ink needs to be determined more frequently than in the case of the other ink cartridges 20Y, 20M, and 20C.

As described above, in order to determine the ink remaining amount in the ink cartridge 20 of the determination target, it is necessary to measure not only the capacitance between the electrode pair 8 corresponding to the ink cartridge 20 of the determination target but also the capacitance between the electrode pair 9 corresponding to the reference case 30. The electrode pair 9 is a measurement target in the first switching state. Thus, if the electrode pair 8 corresponding to the ink cartridge 20 of the determination target is an electrode pair that is a measurement target in the second switching state, the capacitance measured by the capacitance measurement circuit 130 needs to be measured in both the first switching state and the second switching state.

Thus, in a case where the electrode pair 8K corresponding to the ink cartridge 20K, for which the remaining amount is measured frequently, is the measurement target in the second switching state, the switching circuit 120 switches more frequently between switching states. Thus, the remaining amount determination processing by the CPU 101 requires a higher processing load and a longer processing time. However, according to this embodiment, the electrode pair 8K is set as the measurement target in the first switching state. Thus, the capacitance measurement circuit 130 measures, without requiring switching between the states of the switching circuit 120, the capacitance between the electrode pair 8K and the capacitance between the electrode pair 9. This consequently lowers the processing load and shortens the processing time of the remaining amount determination processing.

The following section will describe one example of the processing operation of the inkjet printer with reference to FIG. 7.

First, the CPU 101 determines whether a print command is received from the external apparatus 200 (S1). When it is determined that the print command is received (S1: YES), the CPU 101 starts the printing processing based on the received print command (S2). In this printing processing, the CPU 101 controls the conveyance mechanism 5 to convey the paper P in the conveyance direction during which the carriage 3 and the head 4 are caused to move in the scan direction while ejecting ink, thereby printing a desired image and so on onto the paper P.

Next, the CPU 101 determines whether to determine the ink remaining amount in the ink cartridge 20M or the ink cartridge 20Y (S3). For example, the CPU 101 determines to perform determination of the ink remaining amount in the ink cartridge 20 when a particular setting time or longer has elapsed since the previous determination of the ink remaining amount in the ink cartridge 20. Specifically, for example, a timer is provided, and the time and date of the previous determination for each color of ink is stored in the nonvolatile memory 104. The timer is checked periodically. And, when the setting time of any color has elapsed, determination of the ink remaining amount of that color is performed.

When it is determined to perform determination of the ink remaining amount in the ink cartridge 20M or the ink cartridge 20Y (S3: YES), the CPU 101 sets the switching state of the switching circuit 120 to the first switching state (see FIG. 4A) (S4). Thereafter, the CPU 101 controls the capacitance measurement circuit 130 to measure the capacitance between the electrode pair 9 corresponding to the reference case 30 (S5). Next, the CPU 101 sets the switching state of the switching circuit 120 to the second switching state (see FIG. 4B) (S6). Thereafter, the CPU 101 controls the capacitance measurement circuit 130 to measure the capacitance between the electrode pair 8 corresponding to the ink cartridge 20 of the determination target of the ink remaining amount (S7). After the completion of the processing in S7, the processing proceeds to S11.

When it is determined in S3 that determination of the ink remaining amount is neither performed for the ink cartridge 20M nor the ink cartridge 20Y (S3: NO), the CPU 101 determines whether to perform determination of the ink remaining amount in the ink cartridge 20K or the ink cartridge 20C (S8). In this processing of S8, as in the above processing of S3, when the above particular setting time or longer has elapsed since the previous determination of the ink remaining amount in the ink cartridge 20, the CPU 101 determines to perform determination of the ink remaining amount in the ink cartridge 20. The ink remaining amount in the ink cartridge 20K requires determination more frequently than in the case of the ink remaining amount in the other ink cartridges 20. To realize this, the above setting time is set to be shorter for the ink cartridge 20K than in the case of the other ink cartridges 20.

When it is determined to perform determination of the ink remaining amount in the ink cartridge 20K or the ink cartridge 20C (S8: YES), the CPU 101 sets the switching state of the switching circuit 120 to the first switching state (see FIG. 4A) (S9). Thereafter, the CPU 101 controls the capacitance measurement circuit 130 to measure the capacitance between the electrode pair 9 corresponding to the reference case 30 and the capacitance between the electrode pair 8 corresponding to the ink cartridge 20 that is the determination target (S10). After the completion of the processing in S10, the processing proceeds to S11.

In the processing in S11, the CPU 101 determines whether a difference between the capacitance between the electrode pair 8 and the capacitance between the electrode pair 9 measured by the capacitance measurement circuit 130 is smaller than a threshold. When the CPU 101 determines that the difference in the capacitance is not smaller than the threshold (S11: NO), the CPU 101 determines that the ink cartridge 20 of the determination target is not in the empty state and returns to the processing in S3.

When the CPU 101 determines that the difference in the capacitance is smaller than the threshold (S11: YES), the CPU 101 determines that the ink cartridge 20 of the determination target is in the empty state (S12), and the CPU 101 interrupts the printing processing (S13). Then, the CPU 101 controls the touch panel 90 to display a replacement screen to prompt the replacement of the ink cartridge 20 determined as being in the empty state (S14). Next, the CPU 101 determines, based on the detection result by the reception detection sensor 69, whether the ink cartridge 20 determined as being in the empty state is replaced (S15). When the CPU 101 determines that the ink cartridge 20 is replaced (S15: YES), the CPU 101 restarts the interrupted printing processing (S16) and returns to the processing of S3.

When it is determined, in the processing of S8, that determination of the ink remaining amount is neither performed for the ink cartridge 20K nor the ink cartridge 20C (S8: NO), the CPU 101 determines whether the printing processing is ended (S17). When it is determined that the printing processing is not yet ended (S17: NO), the processing returns to S3. When it is determined that the printing processing is ended (S17: YES), the processing returns to S1.

As described above, according to this embodiment, no ink flows between the internal space 31 of the reference case 30 and the head 4. Thus, the capacitance between the electrode pair 9 corresponding to the reference case 30 does not change, even when the head 4 performs an ejection operation, and changes depending on a change in the environment temperature. Thus, by referring to the capacitance between the electrode pair 9, it is grasped as to how much influence is caused upon the capacitance between the electrode pair 8 due to a change in the environment. This consequently improves the accuracy at which the ink remaining amount in the ink cartridge 20 is determined.

When the ink cartridge 20 is received by the first receiver 61, there is a possibility that the ink cartridge 20 is arranged in an orientation inclined relative to the horizontal plane. In this case, a possibility arises where ink is not supplied to the head 4 although ink is stored in the ink cartridge 20. For example, in a state where the ink cartridge 20 is in an orientation that is inclined in the front-rear direction and that is slightly rotated in the clockwise direction than in the orientation shown in FIG. 2A, when the liquid surface of ink has descended to the discharge port 23, ink is still present in the vicinity of the lower part of the front wall 22*f* of the ink cartridge 20. In contrast with this embodiment, if the electrode pair 8 is arranged closer to the front wall 22*f* than the rear wall 22*b* of the ink cartridge 20, even when the ink surface descends to the discharge port 23 and ink is prevented from being supplied to the head 4, it may be erroneously determined that it is not in the empty state, and processing may not be performed to control the touch panel 90 to display a screen to prompt the replacement of the ink cartridge 20. However, according to this embodiment, the electrode pair 8 is arranged at the rear wall 22*b* side of the ink cartridge 20 and is arranged in the vicinity of the discharge port 23. Thus, determination is performed as to whether the ink remaining amount in the ink cartridge 20 requires the replacement of the ink cartridge, even when the ink cartridge 20 is arranged in an orientation that is inclined relative to the horizontal plane.

Furthermore, the electrode 7 is provided outside the ink cartridge 20 and outside the reference case 30. Thus, when compared with a configuration in which the electrode 7 is provided in the ink cartridge 20, the amount of ink that can be stored in the cartridge 20 is increased.

In the embodiment described above, the head 4 is an example of a "liquid ejector". The ink cartridge 20 is an example of a "liquid container". The reference case 30 is an example of a "reference container". The electrode pair 8 is an example of a "first electrode pair". The electrode pair 9 is an example of a "second electrode pair". The CPU 101 is an example of a "controller". The switch circuit 120 is an example of a "switch". The holder 6 is an example of a "receiver". The left side wall 30*l* and the right side wall 30*r* of the reference case 30 and the left side wall 22*l* and the right side wall 22*r* of the ink cartridge 20 are examples of a "wall".

Second Embodiment

The following section will describe a second embodiment of this disclosure. In the first embodiment, one reference case 30 is provided for four ink cartridges 20. In the second embodiment, the reference case 30 (30K, 30Y, 30C, 30M) is provided for each ink cartridge 20 (of each ink color). Each of the four reference cases 30 stores the same ink as that stored in the corresponding ink cartridge 20. In the following description, the same parts as those of the first embodiment described above are designated with the same reference numerals to avoid duplicating description.

Figure 8A:
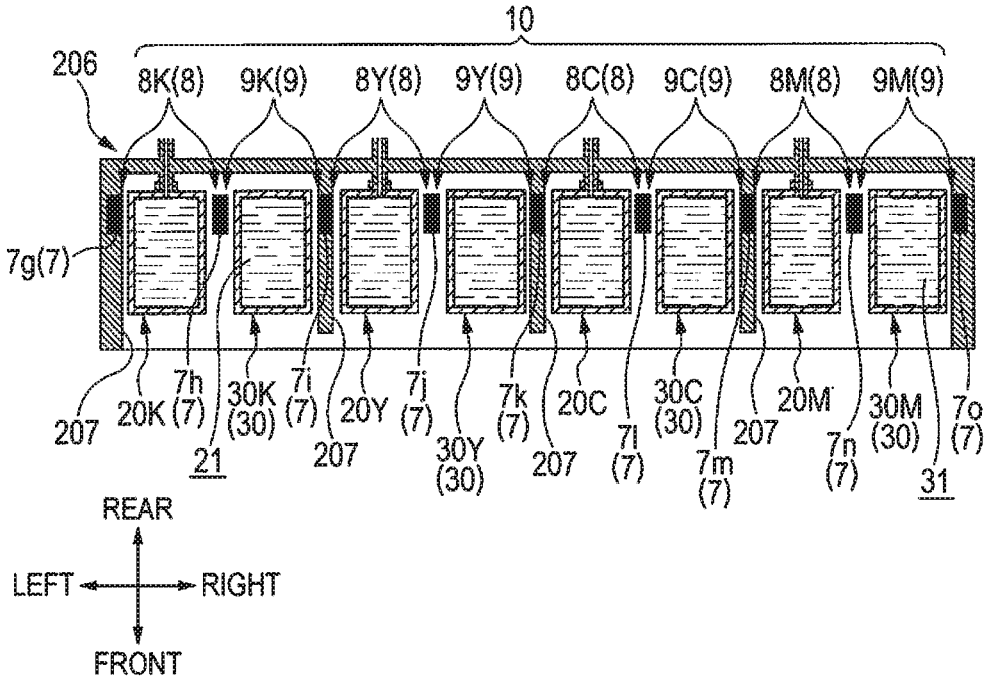
FIG. 8A is a schematic plan view illustrating a holder, ink cartridges, and reference cases according to a second embodiment.

As shown in FIG. 8A, in the second embodiment, instead of the holder 6, the housing 1 a accommodates a holder 206 that receives four ink cartridges 20 in a detachable manner and that receives four reference cases 30. Specifically, the holder 206 has four receivers 207 arranged in the left-right direction. Each receiver 207 receives the ink cartridge 20 and the reference case 30 that store ink of the same color. For example, the receiver 207 receives the ink cartridge 20K and receives the reference case 30K that stores black ink.

The four reference cases 30 are neither connected to the head 4 nor the ink cartridge 20K and thus no ink flows therebetween. Specifically, the amount of the ink stored in the four reference cases 30 does not change regardless of the ejection operation of the head 4.

The holder 206 has nine electrodes 7*g* to 7*o* arranged in this order from the left side in the left-right direction. The nine electrodes 7*g* to 7*o* have the same configuration as those of the electrodes 7*a* to 7*f* in the first embodiment described above. In the following description, the nine electrodes 7*g* to 7*o* will be collectively referred to as "electrode 7" when no differentiation is made thereamong or when collective reference is made to the electrodes.

The nine electrodes 7 constitute eight electrode pairs 10 arranged in the left-right direction. The eight electrode pairs 10 consist of four electrode pairs 8 (8Y, 8M, 8C, and 8Y) corresponding to four ink cartridges 20 and four electrode pairs 9 (9Y, 9M, 9C, and 9Y) corresponding to four reference cases 30.

Figure 8B:
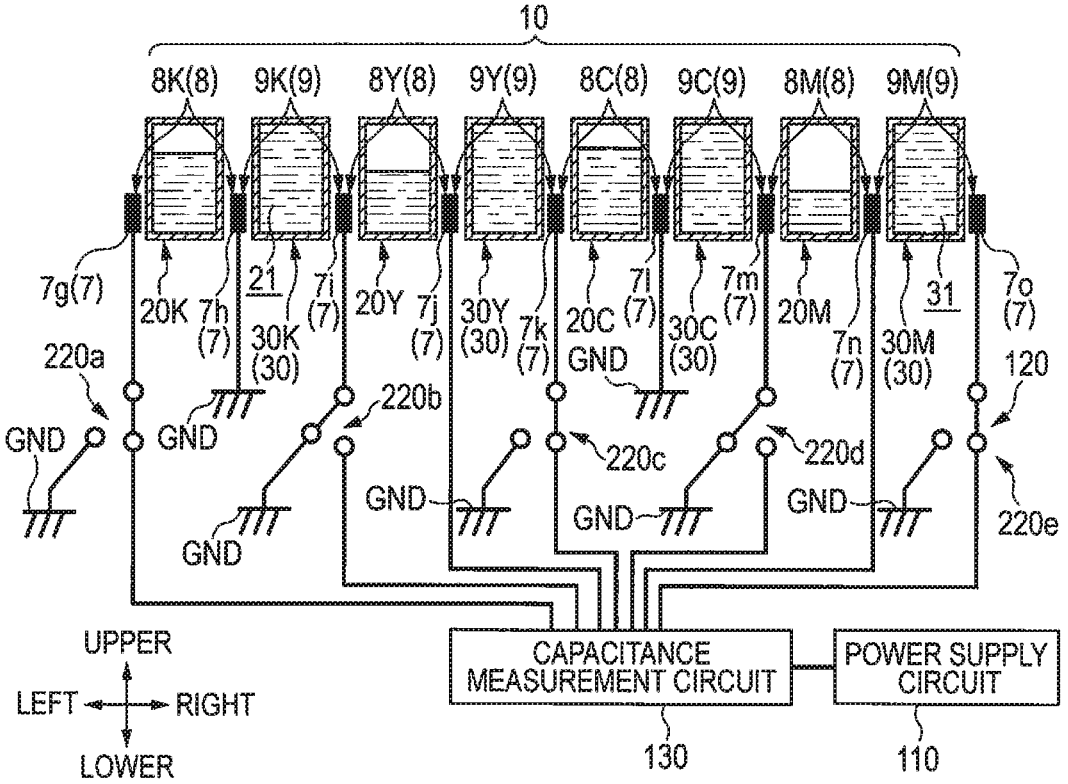
FIG. 8B schematically illustrates the connection between electrodes and a capacitance measurement circuit.

As shown in FIG. 8B, the switching circuit 120 has five switches 220*a* to 220*e* that switch the connection destinations of five electrodes 7*g*, 7*i*, 7*k*, 7*m*, and 7*o* between the ground GND and the capacitance measurement circuit 130. Under control by the controller 100, the switching circuit 120 switches between two switching states of the first switching state and the second switching state. The first switching state is a switching state in which the four electrode pairs 9 having therebetween the reference cases 30 are set as the measurement target for capacitance. On the other hand, as shown in FIG. 8B, the second switching state is a switching state in which the four electrode pairs 8 having therebetween the ink cartridges 20 are set as the measurement target for capacitance.

In this embodiment, the ink stored in each reference case 30 has a liquid surface located above the upper end position of the electrodes 7. In the above configuration, when the ink in the ink cartridge 20 has a liquid surface located above the upper end position of the electrode 7, substantially no difference exists between the capacitance between the electrode pair 8 corresponding to the ink cartridge 20 and the capacitance between the electrode pair 9 corresponding to the reference case 30 storing ink having the same color as the ink in the ink cartridge 20. As the liquid surface of the ink in the ink cartridge 20 descends to a level lower than the upper end position of the electrode 7, a difference increases between the capacitance between the electrode pair 8 and the capacitance between the electrode pair 9. When the ink remaining amount in the ink cartridge 20 is zero, the difference between the capacitance between the electrode pair 8 and the capacitance between the electrode pair 9 is at a maximum. In consideration of this, in this embodiment, it is determined that the ink cartridge 20 is in an empty state when a difference larger than or equal to a particular threshold is present between the capacitance between the electrode pair 8 corresponding to the ink cartridge 20 of the determination target and the capacitance between the electrode pair 9 storing ink having the same color as the ink in the ink cartridge 20.

Figure 9:
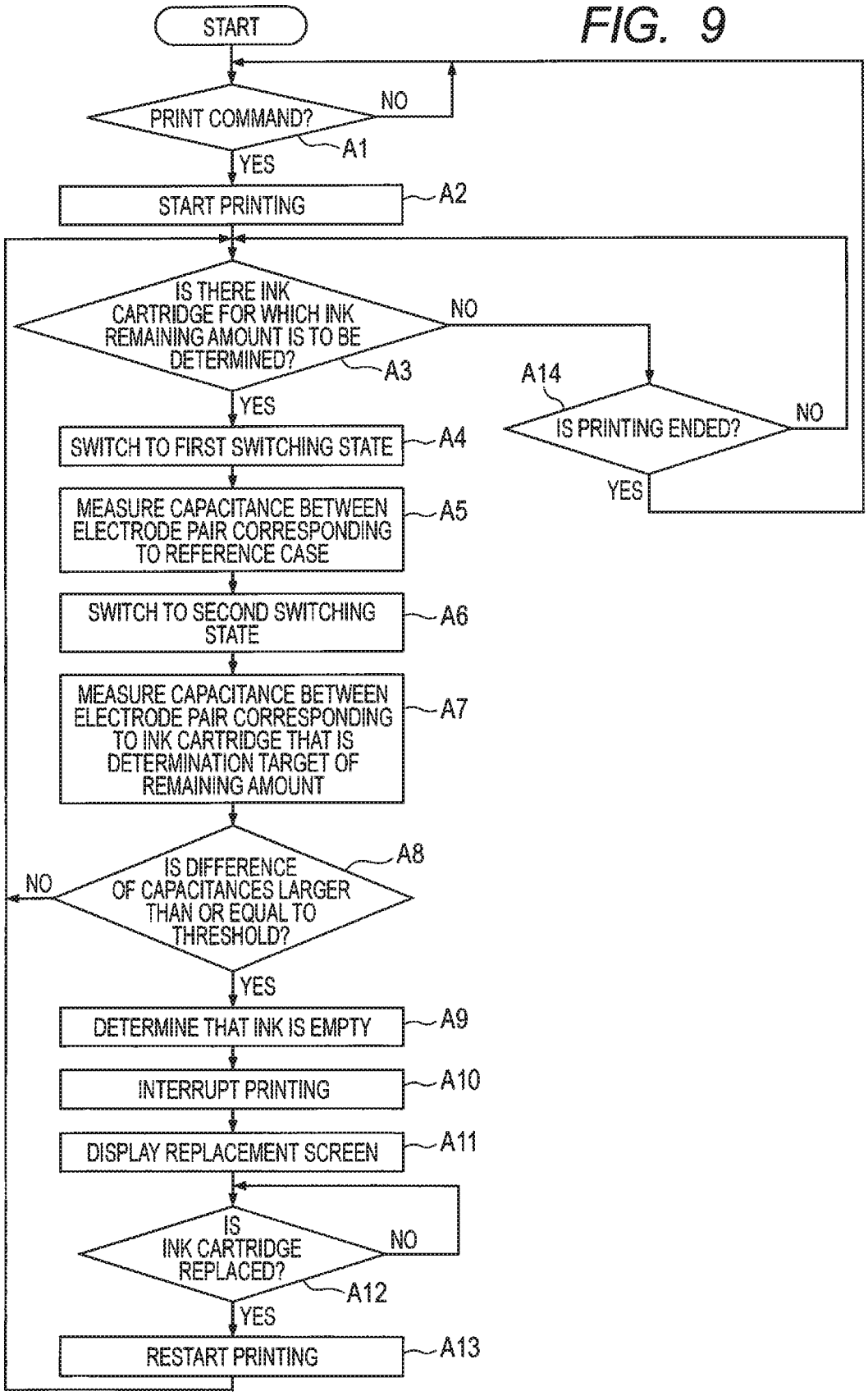
FIG. 9 illustrates a processing operation of an inkjet printer according to the second embodiment.

The following section will describe one example of the processing operation in the inkjet printer with reference to FIG. 9.

The CPU 101 performs the processing of A1 and A2 similar to the processing of S1 and S2 described above. Thereafter, the CPU 101 determines whether the four ink cartridges 20 include any ink cartridge 20 for which the ink remaining amount should be determined (A3). When there is an ink cartridge 20 for which the ink remaining amount should be determined (A3: YES), the CPU 101 sets the switching state of the switching circuit 120 to the first switching state (A4). Thereafter, the CPU 101 controls the capacitance measurement circuit 130 to measure the capacitance between the electrode pair 9 corresponding to the reference case 30 that stores ink having the same color as the ink in the ink cartridge 20 of the determination target (A5). Next, the CPU 101 sets the switching state of the switching circuit 120 to the second switching state (see FIG. 8B) (A6). Thereafter, the CPU 101 controls the capacitance measurement circuit 130 to measure the capacitance between the electrode pair 8 corresponding to the ink cartridge 20 of the determination target of the ink remaining amount (A7).

Thereafter, the CPU 101 determines whether a difference between the capacitance between the electrode pair 8 measured by the capacitance measurement circuit 130 and the capacitance between the electrode pair 9 is larger than or equal to a threshold (A8). When it is determined that a difference in the capacitance is not larger than or equal to the threshold (A8: NO), the CPU 101 determines that the ink cartridge 20 of the determination target is not in the empty state and returns to the processing of A3. When it is determined that the difference in the capacitance is larger than or equal to the threshold (A8: YES), the CPU 101 determines that the ink cartridge 20 of the determination target is in an empty state (A9). Then, the processing of A10 to A13 similar to the processing of S13 to S16 described above is performed and the processing returns to A3.

When the CPU 101 determines in A3 that determination of the ink remaining amount is not performed for any one of the ink cartridges 20 (A3: NO), the CPU 101 performs the processing of A14 similar to the processing of S17 described above.

As described above, according to this embodiment, there is no change in the amounts of ink in the reference cases 30 regardless of the ejection operation in the head 4. Thus, the capacitance between the electrode pairs 9 provided to correspond to the reference cases 30 do not change even when the ejection operation is performed by the head 4 but change depending on a change in the environment temperature. Thus, by referring to the capacitance between the electrode pairs 9, it is possible to grasp how much influence is caused by a change in the environment on the capacitance between the electrode pairs 8. This consequently improves the accuracy at which the ink remaining amount in the ink cartridges 20 is determined.

While the disclosure has been described in detail with reference to the above aspects thereof, it would be apparent to those skilled in the art that various changes and modifications may be made therein without departing from the scope of the claims.

For example, in the embodiments described above, an ink cartridge is described as an example of the liquid container for which the ink remaining amount is determined. However, this disclosure is not limited to this. For example, the liquid container may be a buffer tank provided in the head.

Figure 10A:
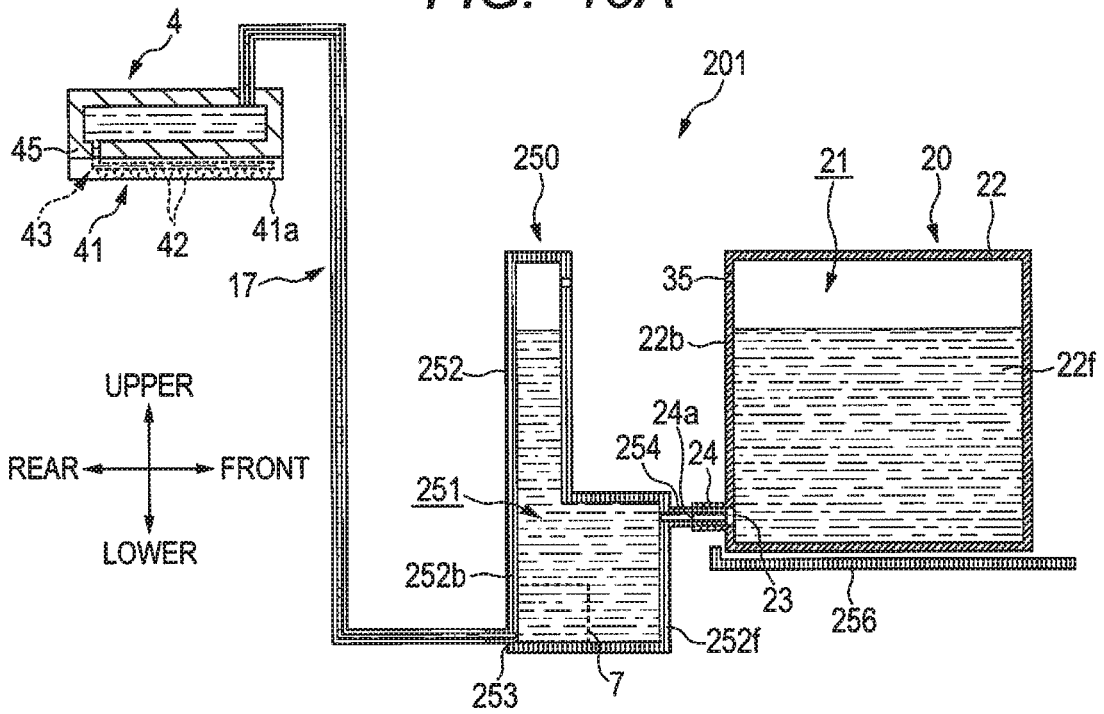
FIG. 10A is a vertical cross-sectional view schematically illustrating an inkjet head, a subsidiary tank, and an ink cartridge according to a modification.
Figure 10B:
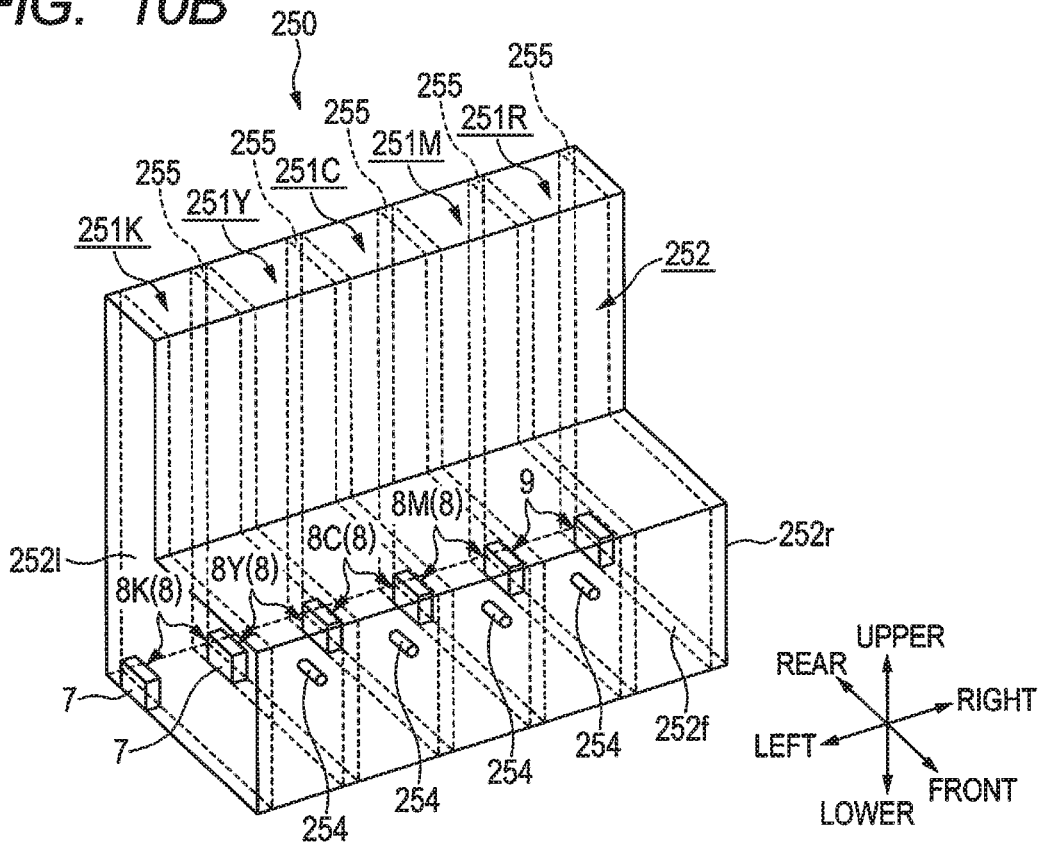
FIG. 10B is a perspective view illustrating the subsidiary tank.

As shown in FIGS. 10A and 10B, a printer 201 also may include a subsidiary tank 250 provided between the ink cartridge 20 and the head 4. The following section will describe this modification in detail.

In this modification, the holder 6 is substituted with a holder 256. The holder 256 receives four ink cartridges 20K, 20Y, 20M, and 20C in a detachable manner The subsidiary tank 250 is provided at the rear side of the holder 256. The subsidiary tank 250 is formed from resin. The subsidiary tank 250 includes an internal space that is divided into five internal spaces 251 by four partition walls 255. The partition walls 255 are walls extending along the vertical plane parallel to the front-rear direction. The five internal spaces 251 have an equal width in the left-right direction.

Among the internal spaces 251, four internal spaces 251K, 251Y, 251M, and 251C store black, yellow, cyan, and magenta inks, respectively. The remaining one internal space 251R stores no ink. The internal space 251R is not connected to (no fluid communication with) the other internal spaces 251K, 251Y, 251M, and 251C or the head 4. That is, no ink is supplied to the internal space 251R.

The subsidiary tank 250 has a front wall 252*f* connected to needles 254 that are connected to the four internal spaces 251K, 251Y, 251M, and 251C, respectively. When the ink cartridge 20 is received by the holder 256, the needles 254 are inserted to the insertion holes 24*a* of the ink cartridge 20 to thereby supply, through the needles 254, the ink in the ink cartridge 20 to the internal spaces 251K, 251Y, 251M, and 251C of the subsidiary tank 250.

The rear wall 252*b* of the subsidiary tank 250 has, at a lower part thereof, a discharge port 253 penetrating through the rear wall 252*b* in the front-rear direction. The discharge port 253 is connected to the tube 17 so that the ink stored in the ink cartridge 20 and the subsidiary tank 250 is supplied to the head 4 through the tube 17.

One electrode 7 is embedded in each of six walls of the left side wall 2521, the right side wall 252*r*, and the four partition walls 255 of the subsidiary tank 250. That is, the six electrodes 7 are arranged in the left-right direction in the subsidiary tank 250.

The six electrodes 7 constitute the five electrode pairs 10 as in the first embodiment. That is, in the five electrode pairs 10, the electrodes 7 have an equal size to one another. The electrode pairs 10 also have an equal interval therebetween. The six electrodes 7 are arranged at the same positions in the front-rear direction and are arranged at the same positions in the upper-lower direction. The five electrode pairs 10 consist of the electrode pairs 8 corresponding to the internal spaces 251K, 251Y, 251M, and 251C for storing ink and the electrode pair 9 corresponding to the internal space 251R in which no ink is stored.

In the above configuration, the CPU 101 determines, as in the first embodiment, the ink stored in the internal spaces 251K, 251Y, 251M, and 251C by acquiring the capacitance between the electrode pairs 8 corresponding to the internal spaces 251K, 251Y, 251M, and 251C of the determination subject and the capacitance between the electrode pair 9 corresponding to the internal space 251R in which no ink is stored, and thereby determines the ink remaining amount in the internal spaces 251K, 251Y, 251M, and 251C. In the modification described above, in the subsidiary tank 250, walls that divide the internal spaces 251K, 251Y, 251M, and 251C are an example of the "liquid container" and walls that divide the internal space 251R are an example of the "reference container".

The other modifications will be described below.

In the embodiments described above, the determination of the ink remaining amount in the ink cartridge 20 (liquid container) is performed by determining whether the ink remaining amount in the ink cartridge 20 is zero. However, this disclosure is not limited to this. Another configuration may be used to determine how much liquid is stored in the liquid container. Specifically, the surface position (surface level) of the liquid in the liquid container may be determined. For example, in a configuration where liquid is stored in the reference container, when a change in the environment occurs, a change in the dielectric constant may be estimated for a dielectric body (a liquid container or liquid) that exists between the first electrode pair, based on the capacitance between the second electrode pair. Further, in a configuration where the electrodes of the first electrode pair extend from the upper end position to the lower end position of the space of the liquid container, a change in the liquid surface position of liquid in the liquid container causes a change in the capacitance between the first electrode pair. Thus, the liquid surface position of the liquid in the liquid container may be determined by referring to the capacitance between the first electrode pair and the capacitance between the second electrode pair.

In the embodiments described above, one electrode pair 8 (the first electrode pair) is provided for one ink cartridge 20 (liquid container). However, a plurality of first electrode pairs may be provided for one ink cartridge 20. For example, a plurality of first electrode pairs may be arranged in the upper-lower direction. In this configuration, the liquid surface position of the ink in the liquid container is determined accurately.

In the embodiments described above, data of the capacitance between the electrode pairs is acquired by using the first electrode pair and the second electrode pair in order to determine the ink remaining amount in the liquid container. However, this disclosure is not limited to this. Arbitrary types of data may be acquired by using the electrode pairs. For example, in a case where the liquid is electrically conductive liquid, the ink remaining amount in the liquid container may be determined by acquiring the resistance value or the current value between the electrodes of the first electrode pair and between the electrodes of the second electrode pair.

The method of measuring the capacitance between electrode pairs is not limited to the method of the embodiments described above, and an arbitrary method may be used. For example, the bridge method, a method based on a resonance frequency, a method using a flying capacitor, and so on may be used.

In the embodiments described above, the CPU 101 of the printer 1 performs determination of the ink remaining amount by using the electrode pair 8 provided for the ink cartridge 20 and the electrode pair 9 provided for the reference case 30. However, this disclosure is not limited to this. For example, the liquid ejection apparatus sends, to an external apparatus, data including a value acquired by using the first electrode pair and a value acquired by using the second electrode pair. Based on the received data, the external apparatus may determine the remaining liquid amount.

The electrode pair 8 is provided outside the ink cartridge 20 and the electrode pair 9 is provided outside the reference case 30. However, this disclosure is not limited to this. The first electrode pair may be provided in the liquid container, and the second electrode pair may be provided in the reference container.

In the embodiments described above, the internal space 31 of the reference case 30 is not connected to (no fluid communication with) the head 4. However, this disclosure is not limited to this. For example, the space of the reference container and the liquid ejector may be connected through a gas permeation membrane that permits gas to pass therethrough while preventing liquid to pass therethrough.

In a configuration where the reference container defines a space to store liquid, the space of the reference container may be connected to the liquid ejector or the liquid container so long as the amount of the liquid in the reference container does not change regardless of the ejection operation of the liquid ejector. For example, the internal space of a case for storing liquid is divided into a first space and a second space by a partition plate extending in the vertical direction. The upper end of the partition plate has a connection portion penetrating in the horizontal direction. The connection portion provides communication between the first space and the second space. The first space has a discharge port that discharges liquid to the liquid ejector. In an initial state, liquid is stored in both of the first space and the second space. In the above configuration, the first space corresponds to a space defined by the liquid container, and the second space corresponds to a space defined by the reference container. The liquid ejection operation by the liquid ejector causes the reduction of the liquid stored in the first space defined by the liquid container, but the amount of liquid stored in the second space does not decrease due to the partition plate. Thus, the ink remaining amount in the first space may be determined accurately by providing the first electrode pair for the liquid container defining the first space and by providing the second electrode pair for the reference container defining the second space.

In the embodiments described above, the case 22 of the ink cartridge 20 and the reference case 30 are formed from the same material. However, this disclosure is not limited to this. Only the left side wall **22*l* and the right side wall 22*r* of the case 22 as well as the left side wall 30*l* and the right side wall 30*r* of the reference case 30** may be formed from the same resin material. Further, the liquid container and the reference container may be formed from different resin materials as long as the liquid container and the reference container have substantially the same dielectric constant.

In the embodiments described above, each of the two electrode pairs 10 adjacent to each other in the left-right direction is configured so that one electrode of each pair is a common electrode. However, one electrode of each pair may not be a common electrode. In this case, a larger number of electrodes are required but there is no need to provide the switching circuit as in the embodiments described above.

In the embodiments described above, every time the ink remaining amount in the ink cartridge 20 is determined, the capacitance between the electrode pair 9 corresponding to the reference case 30 is calculated. However, it is not necessary to calculate the capacitance between the electrode pair 9 every time the ink remaining amount in the ink cartridge 20 is determined. For example, when the ink remaining amount is determined a plurality of times during the execution of the printing processing, the capacitance between the electrode pair 9 may be calculated only at the first determination of the ink remaining amount.

In the embodiments described above, the ink cartridge 20 and the reference case 30 are accommodated in the housing **1*a* of the inkjet printer 1**. However, this disclosure is not limited to this. For example, the liquid container and the reference container may be accommodated in a housing provided outside the printer.

The liquid stored in the liquid container is not limited to ink and may be any liquid (for example, processing liquid for causing components in the ink to agglutinate or precipitate). If the two electrodes of the first electrode pair have the same relative positional relationship as the two electrodes of the second electrode pair, there is no need to arrange the two electrodes of each of the electrode pairs in parallel. Further, the two electrodes of each of the electrode pairs may be arranged at different positions (shifted positions) in a direction perpendicular to the direction in which the electrode pairs are arranged. The electrodes of the first electrode pair are not required to be arranged to sandwich the liquid container in the horizontal direction, and may be arranged to sandwich the liquid container in the upper-lower direction, for example. Similarly, the electrodes of the second electrode pair are not required to be arranged to sandwich the reference container in the horizontal direction, and may be arranged to sandwich the reference container in the upper-lower direction, for example.

The interval between two walls of the reference container may be different from the interval between the two walls of the liquid container. The liquid container and the reference container are formed from resin and thus are dielectric bodies having a larger dielectric constant than air and so on. Accordingly, for example, in a configuration where no liquid is stored and only air is stored in the reference container as in the first embodiment, the influence caused by the air in the reference container and the liquid container upon the capacitance between the first electrode pair and the second electrode pair is smaller than the influence caused by the two walls of the reference container and the liquid container upon the capacitance. Accordingly, even if the interval between the two walls of the reference container is different from the interval between the two walls of the liquid container, the accuracy of determining the remaining liquid amount does not deteriorate significantly.

This disclosure may be also applied to a so-called line-type inkjet printer that prints an image on paper that is conveyed by a conveyance mechanism in a state where an inkjet head is fixed. This disclosure is not limited to an inkjet printer, but may be also applied to a facsimile machine, a copying machine, a multifunction peripheral, and so on.

What is claimed is:

1. A liquid ejection apparatus comprising:

a liquid ejector configured to eject liquid;

a resin-made liquid container defining a space storing liquid to be supplied to the liquid ejector, the liquid container being configured such that a remaining amount of liquid therein changes due to an ejection operation of liquid by the liquid ejector;

a resin-made reference container defining a space in which no liquid flows to the liquid ejector or from the liquid ejector;

a first electrode pair provided to correspond to the liquid container; and a second electrode pair provided to correspond to the reference container.

2. The liquid ejection apparatus according to claim 1, wherein the space defined by the reference container has no fluid communication with the liquid ejector.

3. The liquid ejection apparatus according to claim 1, wherein the space defined by the liquid container has no fluid communication with the space defined by the reference container.

4. The liquid ejection apparatus according to claim 1, further comprising a controller, wherein the controller is configured to determine a remaining amount of liquid in the liquid container by using the first electrode pair and the second electrode pair.

5. The liquid ejection apparatus according to claim 4, wherein the controller is configured to:

acquire each of a first capacitance between the first electrode pair and a second capacitance between the second electrode pair; and determine the remaining amount of liquid in the liquid container based on an acquired result.

6. The liquid ejection apparatus according to claim 5, wherein an interval between the first electrode pair is equal to an interval between the second electrode pair; and wherein electrodes of the first electrode pair have a same size, electrodes of the second electrode pair have a same size, and the size of the electrodes of the first electrode pair is same as the size of the electrodes of the second electrode pair.

7. The liquid ejection apparatus according to claim 5, wherein the first electrode pair is provided outside the liquid container;

wherein the second electrode pair is provided outside the reference container;

wherein the liquid container includes two walls arranged in a direction in which the first electrode pair is arranged;

wherein the reference container includes two walls arranged in a direction in which the second electrode pair is arranged;

wherein the walls of the liquid container and the reference container have a same thickness; and wherein the walls of the liquid container and the reference container are made from a same material.

8. The liquid ejection apparatus according to claim 7, wherein an interval between the two walls of the liquid container is equal to an interval between the two walls of the reference container.

9. The liquid ejection apparatus according to claim 5, wherein the reference container stores no liquid therein; and wherein the controller is configured to, under a condition that a difference between the first capacitance and the second capacitance is smaller than a particular threshold, determine that the remaining amount of liquid in the liquid container is zero.

10. The liquid ejection apparatus according to claim 5, further comprising:

a power supply configured to generate a voltage; and a switch configured to selectively switch between:

connecting the power supply with the first electrode pair; and connecting the power supply with the second electrode pair, wherein one electrode of the first electrode pair and one electrode of the second electrode pair are a common electrode; and wherein the controller is configured to:

when determining the remaining amount of liquid in the liquid container, control the switch to switch the connection destination of the power supply in order to perform connection between the first electrode pair and the power supply and to perform connection between the second electrode pair and the power supply.

11. The liquid ejection apparatus according to claim 5, further comprising:

a power supply configured to generate a voltage;

a plurality of liquid containers configured to store liquid of respective ones of a plurality of colors, the plurality of liquid containers including a black container configured to store black liquid;

a plurality of first electrode pairs provided to correspond to respective ones of the plurality of liquid containers, the plurality of first electrode pairs including a black first electrode pair corresponding to the black container and an other first electrode pair different from the black first electrode pair; and a switch configured to selectively switch between:

connecting the power supply with both the black first electrode pair and the second electrode pair; and connecting the power supply with the other first electrode pair, wherein the plurality of first electrode pairs and the second electrode pair are arranged in a particular direction;

wherein one of the plurality of liquid containers and the reference container is arranged between a particular electrode and an other electrode adjacent to the particular electrode, the particular electrode being one electrode of the plurality of first electrode pairs and the second electrode pair; and wherein the controller is configured to, when determining the remaining amount of liquid in the liquid container, control the switch to switch a connection destination of the power supply to a target first electrode pair, the target first electrode pair corresponding to the liquid container of a determination target for which the remaining amount of liquid is to be determined.

12. The liquid ejection apparatus according to claim 1, wherein the reference container stores no liquid therein.

13. The liquid ejection apparatus according to claim 1, wherein liquid is stored in the reference container in a sealed state.

14. The liquid ejection apparatus according to claim 1, further comprising a housing configured to accommodate the liquid ejector, wherein the liquid container and the reference container are arranged in the housing.

15. The liquid ejection apparatus according to claim 1, wherein the first electrode pair is provided outside the liquid container; and wherein the second electrode pair is provided outside the reference container.

16. The liquid ejection apparatus according to claim 1, wherein one electrode of the first electrode pair and one electrode of the second electrode pair are a common electrode.

17. The liquid ejection apparatus according to claim 16, wherein the liquid container and the reference container are arranged in a predetermined direction; and wherein the common electrode is arranged between the liquid container and the reference container in the predetermined direction.

18. The liquid ejection apparatus according to claim 1, further comprising a receiver configured to detachably receive the liquid container and to receive the reference container, wherein the first electrode pair and the second electrode pair are provided at the receiver.

19. The liquid ejection apparatus according to claim 1, wherein a discharge port is formed at one end of the liquid container in a horizontal direction, the discharge port being configured to discharge liquid to the liquid ejector; and wherein the first electrode pair is arranged closer to the one end of the liquid container than to another end of the liquid container in the horizontal direction.

20. A liquid ejection apparatus comprising:

a liquid ejector configured to eject liquid;

a resin-made liquid container defining a space storing liquid to be supplied to the liquid ejector, the liquid container being configured such that a remaining amount of liquid therein changes due to an ejection operation of liquid by the liquid ejector;

a resin-made reference container defining a space storing liquid, the reference container being configured such that an amount of liquid therein is unchanged regardless of the ejection operation of liquid by the liquid ejector;

a first electrode pair provided to correspond to the liquid container; and a second electrode pair provided to correspond to the reference container.

* * * * *